US007063028B2

(12) United States Patent
Codos et al.

(10) Patent No.: US 7,063,028 B2
(45) Date of Patent: Jun. 20, 2006

(54) PRINTING AND QUILTING METHOD AND APPARATUS

(75) Inventors: Richard N. Codos, Warren, NJ (US); M. Burl White, Jackson Beach, FL (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/957,862

(22) Filed: Oct. 4, 2004

(65) Prior Publication Data

US 2005/0051071 A1 Mar. 10, 2005

Related U.S. Application Data

(63) Continuation of application No. 10/185,324, filed on Jun. 27, 2002, now Pat. No. 6,848,846, which is a continuation of application No. 09/822,794, filed on Mar. 30, 2001, now Pat. No. 6,435,177, which is a continuation-in-part of application No. 09/649,471, filed on Aug. 28, 2000, now Pat. No. 6,263,816.

(51) Int. Cl.
*D05B 11/00* (2006.01)

(52) U.S. Cl. ..... 112/2.1; 112/102.5; 112/475.19

(58) Field of Classification Search ..... 112/102.5, 112/470.06, 2.1, 475.19
See application file for complete search history.

(56) References Cited

U.S. PATENT DOCUMENTS 3,477,322 A 11/1969 Gerber et al.
3,611,961 A 10/1971 Lopez et al.
3,701,165 A * 10/1972 Huddleston ..... 2/243.1
3,960,095 A 6/1976 Story
4,301,999 A 11/1981 Higgins et al.
4,526,830 A * 7/1985 Ferziger et al. ..... 442/139
4,665,619 A 5/1987 Pearl
4,675,253 A 6/1987 Bowditch
4,748,920 A 6/1988 Stutznacker
4,785,750 A * 11/1988 Best ..... 112/475.02

(Continued)

FOREIGN PATENT DOCUMENTS

DE 4120293 2/1992

(Continued)

OTHER PUBLICATIONS http://web.archive.org/web/*/http://http://www.winnowing.com/ppp.html, Oct. 4, 1999.*

*Primary Examiner*—John J. Calvert
*Assistant Examiner*—Brian Kauffman
(74) *Attorney, Agent, or Firm*—Wood, Herron & Evans, L.L.P.

(57) ABSTRACT

A quilting machine (10, 100, 200, 300, 400, 500, 600) is provided with a printing station (20, 125, 225, 325, 425, 525, 611, 626, 631) and a quilting station (44, 127, 227, 327, 427, 527, 627, 632), either on the same or a different production line. Ticking is preprinted with a plurality of different patterns, organized and coordinated by the computer so that a print head can scan the material and print different patterns of different panels (32). Identifying data (40) for matching the panels of a mattress product can be provided in data files and codes can be printed on the fabric. Panels can be matched and assembled into products based on the codes, and quilting, cutting, slitting and other operations can be controlled by printed codes and other data. The quilting and combining of the panels for assembly of a mattress product can be carried out manually or automatically using the data.

5 Claims, 12 Drawing Sheets

U.S. PATENT DOCUMENTS 4,814,218 A * 3/1989 Shane ..... 428/102
4,860,675 A 8/1989 Brower et al.
4,916,819 A 4/1990 Gerber
4,953,485 A 9/1990 Brower et al.
5,018,416 A 5/1991 Freermann
5,022,323 A 6/1991 Schultheis
5,027,133 A 6/1991 Weiselfish
5,040,473 A 8/1991 Zesch et al.
5,095,835 A 3/1992 Jernigan et al.
5,099,773 A 3/1992 Codos
5,144,899 A 9/1992 Allen
5,154,130 A 10/1992 Gribetz et al.
5,159,874 A 11/1992 Adamski, Jr. et al.
5,289,788 A 3/1994 Fukumoto
5,461,999 A 10/1995 Marcangelo
5,533,459 A * 7/1996 Fontana ..... 112/475.08
5,544,599 A 8/1996 Frazer et al.
5,685,250 A 11/1997 Kaetterhenry et al.
5,697,309 A * 12/1997 Ogle et al. ..... 112/2.1
5,855,176 A 1/1999 Takenoya et al.
5,859,653 A 1/1999 Aoki et al.
5,873,315 A * 2/1999 Codos ..... 112/117
6,012,403 A 1/2000 Codos et al.
6,116,978 A * 9/2000 Clemens ..... 446/85
6,244,700 B1 6/2001 Kimura et al.
6,295,480 B1 * 9/2001 Kayanaka et al. ..... 700/133
6,296,403 B1 10/2001 Duchovne
6,374,151 B1 * 4/2002 Amano et al. ..... 700/133

FOREIGN PATENT DOCUMENTS

EP WO99/53809 10/1999

* cited by examiner

PRINTING AND QUILTING METHOD AND APPARATUS

This application is a Continuation of Ser. No. 10/185,324, filed Jun. 27, 2002 now U.S. Pat. No. 6,848,846, which is a continuation of Ser. No. 09/822,794, filed Mar. 30, 2001, now U.S. Pat. No. 6,435,177, which is a Continuation-in-Part of Ser. No. 09/649,471, filed Aug. 28, 2000, now U.S. Pat. No. 6,263,816, each hereby expressly incorporated herein by reference, and to which priority is claimed.

This application is also related to Ser. No. 09/480,094, filed Jan. 10, 2000, now U.S. Pat. No. 6,158,366, of which Ser. No. 09/649,471 is a Continuation-in-Part, and which is a Continuation-In-Part of Ser. No. 09/250,352, filed Feb. 16, 1999, now U.S. Pat. No. 6,012,403, which is a Continuation-In-Part of U.S. patent application Ser. No. 09/070,948, filed May 1, 1998, now U.S. Pat. No. 5,873,315, all of which are hereby expressly incorporated by reference herein.

FIELD OF THE INVENTION

The present invention relates to quilting, and particularly to the quilting of pattern bearing products such as mattress covers. The invention further relates to the manufacture of quilted materials that bear printed patterns. The invention is particularly useful where the quilting is performed on multi-needle quilting machines, where the quilting and printing are applied to roll fed or web material or where differing products are produced in small quantities and in batches.

BACKGROUND OF THE INVENTION

Quilting is a special art in the general field of sewing in which patterns are stitched through a plurality of layers of material over a two dimensional area of the material. The multiple layers of material normally include at least three layers, one a woven primary or facing sheet that will have a decorative finished quality, one a usually woven backing sheet that may or may not be of a finished quality, and one or more internal layers of thick filler material, usually of randomly oriented fibers. The stitched patterns maintain the physical relationship of the layers of material to each other as well as provide ornamental qualities. In quilting, two different approaches are generally used.

Single needle quilters of the type illustrated and described in U.S. Pat. Nos. 5,640,916 and 5,685,250, and those patents cited and otherwise referred to therein are customarily used for the stitching of most comforters, some bedspreads and other products from pre-formed or pre-cut rectangular panels. Some single needle quilters are used to quilt patterns on fabric that carries a pre-woven or printed pattern, with the quilting adding to or enhancing the appearance of the pattern. Such quilters require that pre-patterned material be manually positioned in the quilting apparatus so that the quilting can be registered with the pre-applied pattern or a complicated visual positioning system be used. With such systems, border quilting or coarse pattern quilting can be achieved but high quality outline quilting around the pre-applied patterns or the quilting of pattern details of a fraction of an inch in scale are difficult to achieve, particularly automatically. Single needle quilters are usually lock stitch machines.

Large scale quilting operations have been used for many years in the production of bedding products. Mattress covers, which enclose and add padding to inner spring, foam or other resilient core structure, provide functional as well as ornamental features to a mattress. Mattress covers are typically made up of quilted top and bottom panels, which contribute to the support and comfort characteristics of a mattress, and an elongated side panel, which surrounds the periphery of the mattress to join the top and bottom panels around their edges to enclose the inner spring unit or other mattress interior.

Mattresses are made in a small variety of standard sizes and a much larger variety of combinations of interiors and covers to provide a wide range of support and comfort features and to cover a wide range of product prices. To provide variety of support and comfort requirements, the top and bottom panels of mattress covers are quilted using an assortment of fills and a selection of quilted patterns. To accommodate different mattress thicknesses, border panels of different widths are required with variations in the fill for border panels being less common. Border panels as well as top and bottom panels are usually made in different sizes to accommodate all of the standard mattress sizes.

Mattress covers are usually quilted on web-fed multi-needle quilters. Only one side of the quilted product need be finished for a mattress cover, so one layer of ornamental top goods or ticking is usually combined with fill and backing material to produce the mattress cover products on a chain stitch quilting machine which can use large spools of thread and quilt on webs of material supplied on rolls. Multiple needle quilters of the type illustrated in U.S. Pat. Nos. 5,154,130 and 5,544,599 are customarily used for the stitching of mattress covers, some bedspreads and other such products which are commonly formed from multi-layered web fed material. These multi-needle quilters include banks of mechanically ganged needles that sew multiple copies of a recurring pattern on the fabric. With such multi-needle machines, the combining of quilting with pre-applied printed or woven patterns in the fabric which would require registration of the quilting with the pre-applied patterns is usually not attempted. Multi-needle quilters are usually chain stitch machines. Such quilters include banks of mechanically ganged needles that sew multiple copies of a recurring pattern.

The ornamental characteristics of the ticking that form the outer surface of a mattress are regarded as important in the marketing of bedding products. Bedding manufacturers stock a variety of ticking materials of different colors and types, many having different sewn or printed patterns. Maintaining an adequate inventory of ticking requires the stocking of rolls of different widths of materials of different colors and patterns. The cost of such an inventory as well as the storage and handling of such an inventory contributes substantially to the manufacturing cost of bedding products.

Some of these quilted patterns are highly ornate and contribute materially to the appearance of the quilted products, particularly those that are of higher quality and cost, and which are made in smaller quantities. With such high-end products, the combining of quilting with pre-applied printed or woven patterns in the fabric may call for registration of the quilting with the pre-applied patterns, which is difficult to achieve with multi-needle machines. But other quilted products, such as those with simple zig-zag quilted patterns, are more functional, and rely on the varieties of the ticking material for the visual distinctiveness of the product. The varieties of ticking materials include those sewn or printed with different patterns. For such products, printed patterns are usually applied by the ticking supplier and rolls of ticking of each pattern are inventoried by the mattress cover manufacturer.

Other quilting machines and methods employing some of the characteristics of both single needle panel type quilters and web fed multi-needle quilters are disclosed in U.S. patent application Ser. No. 08/831,060 of Jeff Kaetterhenry, et al. filed Apr. 1, 1997 and entitled Web-fed Chain-stitch Single-needle Mattress Cover Quilter with Needle Deflection Compensation, now U.S. Pat. No. 5,832,849 and U.S. patent application Ser. No. 09/189,656 of Bondanza et al. , filed Nov. 10, 1998 and entitled Web-fed Chain-stitch Single-needle Mattress Cover Quilter with Needle Deflection Compensation, both hereby expressly incorporated by reference herein. Such a machine uses one or more separately controllable single needle heads that apply chain stitches to panels or webs.

The production of quilts by off-line processes, that is those involving both printing and quilting processes performed on different production lines, has included specialty product production involving the outlining or other coordinated stitching onto material on which patterns have been preprinted. Stitching in such processes is traditionally carried out with manually guided single needle quilting machines. Proposed automated systems using vision systems to follow a preprinted pattern or other schemes to automatically stitch on the preprinted material have been proposed but have not proven successful. Registration of pattern stitching with preprinted patterns has been a problem. While efforts to align printing and stitching longitudinally or transversely have been made, angular orientation of the printed web and the angular alignment printed patterns with the quilting head has been ignored. Correction for misalignment of quilted and printed patterns by repositioning of a quilting or printing head is inadequate if multi-needle quilters are to be used, particularly where angular mis-orientation is present.

Application of registration techniques to roll fed materials, where printing and quilting are performed on the material webs, presents additional problems. Registration errors that are minor where patterns are applied to individual panels produce cumulative errors when patterns are applied to webs. This is particularly true where angular orientation errors result due to skewing of the web as it is fed into the subsequent pattern applying machine after removed from a machine in which the first pattern has been applied.

With off-line processes for applying one pattern and then another in registration with the first, one by printing and one by quilting, production of quilts in small batches of pattern combinations is particularly a problem. Each batch can include one or a few quilted products of a common design made up of a printed pattern and a quilted pattern in combination, with the products of different batches, preferably to be consecutively made on the same machinery, being made up of a different printed pattern in combination with a different quilted pattern. As a result, the matching of the second pattern to be applied with the correct pre-applied pattern as the partially completed products are moved from a first machine or production line to a second is critical and a potential source of error as well as production delay.

For example, the outer layer of material used for mattress covers that is referred to as ticking is supplied in a variety of colors and preprinted or dyed patterns. Generally, mattress manufacturers who are the customers of the quilted mattress cover manufacturers or quilting machinery manufacturers require a wide variety of ticking material patterns to produce a variety of bedding products. Frequently, small quantities of each of the variety of products must be made to supply their customers' requirements, requiring the maintenance of inventories of a large number of different patterns of ticking material, which involves substantial cost. Further, the need to constantly match patterns as well as to change ticking supply rolls when manufacturing such a variety of products in small quantities can be a major factor in reducing the throughput of a mattress making process and delaying production. These and related problems continually exist in the manufacture of bedspreads, comforters and other quilted products where a variety of products in small quantities is desired.

Other off-line processes may involve the loading of rolls of ticking materials commonly bearing a pre-applied pattern onto the quilting machines. Lower cost mattresses are often made by sewing generic quilted patterns onto printed pattern material. However, frequent changing of the ticking material to produce products having a variety of appearances, requires interruption of the operation of the quilting machine for manual replacement and splicing of the material. This adds to labor costs and lowers equipment productivity. Further, the spliced area of the material web which must be cut from the quilted material is wasted. Furthermore, since mattress top and bottom panels are often thicker, and vary in thickness more than border panels, border panels are sometimes quilted on quilting lines that are separate from those used to quilt the top and bottom panels. Since border panels are usually preferred to match the top and bottom panels, the changing of ticking on the top and bottom panel line is almost always accompanied by a similar change of ticking material on the border panel line. Coordination of the two production lines, as well as the matching of border panels with the top and bottom panels, requires well executed control procedures and can lead to assembly errors or production delays.

There exists a need in mattress cover manufacturing for a capability of efficiently producing small quantities of quilted fabric such as mattress covers, comforters, bedspreads and the like where different pre-applied patterns on the product are desired to be enhanced by combining the pre-applied and quilted patterns, particularly where combinations of quilted patterns and printed or other pre-applied patterns must vary with each or every few products. Further, there is a need in mattress cover manufacturing to improve the productivity and efficiency of making quilted products, particularly mattress covers, having a variety of designs without increasing, or while reducing, production costs.

SUMMARY OF THE INVENTION

An objective of the present invention is to provide quilt manufacturers, particularly mattress cover manufacturers, with the ability to produce quilted products having a wide variety of patterns that include both quilting and printed or other images or designs efficiently and economically. A particular objective of the invention is to provide such ability without the need to inventory material in a large number of different pre-applied designs.

A further objective of the invention is to provide for the intricate outline or other coordinated quilting of designs or patterns on multi-layered materials in a highly efficient, economical, high speed and automated manner, particularly by both applying the printed design or pattern and quilting the outline or other coordinated quilted enhancement of the printed design or pattern in sequence on the same manufacturing line.

Another objective of the present invention is to efficiently provide for customizable printed and quilted patterns on mattress covers, bedspreads and the like, which can be varied on an individual piece basis or with items produced in small quantities. It is a particular objective of the present invention to provide flexibility in the production of mattress ticking and quilted mattress covers having patterns that can differ from product to product.

A further objective of the present invention is to reduce quilting downtime due to the need to make ticking or other material changes, pattern changes or machine adjustments. A more particular objective of the present invention is to provide a quilting method and apparatus with which quilted patterns and printed patterns may be applied in registration and varied on a quilting machine.

A particular objective of the present invention is to aid the production of quilted material by combining both printed patterns and quilted patterns wherein multiple copies of the quilted patterns can be simultaneously applied using a multi-needle quilter. An additional particular objective of the present invention is to facilitate accurate, coordinated application of patterns by printing and quilting to web or roll fed material. Another particular objective of the present invention is to assist in the automatic coordination of printed and quilted patterns of products produced successively in small batches of different products. These objectives are most particularly sought in systems in which a first pattern, such as a printed pattern, is applied off-line from the machine on which the second pattern, such as a quilted pattern, is to be applied in registration with the first pattern.

An additional objective of the present invention is to provide for the efficient arrangement of top, bottom and border panels of different printed patterns on one or more webs or sections of a fabric. A further objective of the invention is to coordinate the matching and assembly of the different panels that make up each of a plurality of differently patterned mattress covers and other products.

According to principles of the present invention, a quilting method and apparatus are provided for the manufacture of a quilted product by a combination of printed pattern application and quilting. The process provided includes the application of the printed pattern and the application of a quilted pattern with the pattern that is applied second being applied in registration with the first. Preferably the printed pattern is applied first. Both the printed and the quilted patterns are printed from electronic source files. The printing is carried out by a process referred to as Direct Digital Printing, which is defined in the industry as commercial-quality printing in which the electronic source files are processed directly on the printing press or printing system, rather than through analog steps such as film imagesetting and platemaking. Even though the included printing may be from electronic source files that may not be literally "digital" and the excluded image setting and plate-making may be literally digital rather than analog as the terms digital and analog are used in the electronics arts. Direct digital printing systems may be based on lithographic offset technology or laser/toner technology. In the preferred embodiment of the invention, the printing is carried out by ink-jet printing processes. Further, in accordance with preferred embodiments of the invention, the printing is applied directly to the substrate without the use of an offset or transfer process.

According to the various embodiments of the present invention, the principles set forth above are achieved by applying printed designs and coordinated quilted patterns to multilayered material on either the same production line, on separate production lines, or under the control of a common machine and pattern controller. On a single line system, multiple layers of the material for forming a quilt are supported on a frame on which a printing head and a quilting head are also mounted. A mechanism is provided to impart relative movement of the supported material relative to the quilting and printing heads. Such a mechanism can include a material conveyor that moves the material with respect to the frame, and/or head transport mechanisms that move the heads to and from the material when it is fixed relative to the frame. Either the supported material or the heads or both are moved relative to each other under the control of a programmed computer control to apply printed designs and quilted patterns to the material in mutual registration. Preferably, the printed designs are applied first onto the top layer or facing material, then a pattern is quilted in registration with the printed designs. Alternatively, printed designs can be applied after the patterns are quilted.

According to certain embodiments, a quilting apparatus is provided with a supply of multiple layers of material to be quilted and printed with a combination printed design and quilt pattern. An outer or top layer is fed, preferably as a continuous web, through a series of stations. At one station, a printed design is applied to the top or facing layer of material. At another station, preferably downstream of the printing station, a quilted pattern is applied to the multiple layered fabric of material including the facing material layer and filler and backing material layers. Whichever pattern or design is applied second, preferably the quilted pattern, it is applied in registration with the pattern or design that has been applied first to the fabric under the control of a programmed controller. A curing station or oven may be further provided downstream or as part of the printing station to cure the dye or ink applied at the printing station.

In certain machines according to the invention, a printing station is provided on a frame and quilting station is located on the frame, preferably downstream from the printing apparatus. A material conveyer is provided that brings fabric printed at the printing station into the quilting station with the location of the printed pattern known so that one or more quilting heads at the quilting station can be registered with the printed pattern.

According to one preferred embodiment of the invention, the printing station includes one or more ink-jet printing or dye transfer heads moveable under computer control over the outer or facing layer of material. Additional layers of material are combined with the outer layer, preferably downstream of the printing station and after a printed pattern is applied to the outer layer at the printing station. In this embodiment, the quilted pattern is then quilted onto the material in registration with the printed pattern. Registration may be achieved by maintaining information in a controller of the location of the printed pattern on a facing material and of the relative location of the heads with respect to the facing material.

In embodiments where the material is moved on a conveyor successively through the printing and quilting stations, information of the location of the design or pattern on the facing material and of the material on the conveyor is maintained by the controller. The material may be fed in separate precut panel sections, as continuous patterns and designs along a web, or in discrete panel sections along a continuous web. Where the printed design is applied before the quilting, which is preferred, information of the exact location of the design on the facing material is maintained as the material moves from the printing station, as the filler and backing layers of material are brought into contact with the outer layer or facing material, and as the material is fed to the quilting station. For example, outline quilting the pattern in computer controlled registration with the printed pattern can be carried out, or some other quilting pattern can be applied, based on the maintained registration information of the pattern on the web moving through the apparatus.

In one preferred embodiment, exact registration between the design that is printed onto the material and the pattern that is quilted on the material is maintained by holding a panel section of the multi-layered material onto which the pattern is printed in some securing structure at and between the printing and quilting stations. The panel section can be a separate panel or a portion of a web of material, and may be secured in place on a conveyor. In such an embodiment, the registration may be maintained throughout the entire printing and quilting operation by side securements such as, for example, a pin-tentering material transport that keeps the material fixed relative to the conveyor or securing structure through the printing process and the quilting process. A programmed or process controller controls the relative movement of the fabric and printing and quilting heads, and coordinates the movement in synchronization with printing head control and quilting head control so that the printed and quilted patterns are applied in precise registration.

In other embodiments, the pattern is applied off-line, preferably the printing process. The printed pattern may include a machine identifiable mark or other reference, such as may be achieved by the printing of selvage edge registration marks on the material that are uniquely positioned relative to the printed pattern. The printed material is then transferred to a quilting line at which a quilted pattern is applied in registration with the printed pattern. Preferably, machine readable registration information is produced on the material at more than one transversely spaced points on the material, such as on opposite selvages or side edges of the material. Separate determinations are made from the plural marks as to the relative alignment at two places on the material, such as at both of the opposite side edges. Thus, two such marks can be located when the second pattern is registered to the first, and determination can be made of the skewing or rotation of the material carrying the first or pre-applied pattern.

Adjustment to eliminate skewing or rotation of the fabric, and thereby to achieve registration of the second pattern with the first at transversely spaced locations on the material, is provided by side-to-side material position adjustment. Preferably, adjustment is provided by a split feed roll, with separately rotatable right and left components that are separately controlled in response to separate determinations of the registration of the right and left sides of the material. Separate servo drives or separately controlled particle brakes can be used to control the feed rolls to steer the web. Feed rolls at the upstream end of the quilter may be controlled with brakes to affect the tension of the web through the quilting station with driven feed rolls at the downstream end of the station, thereby controlling shrinkage or stretch of the web longitudinally.

In the preferred embodiments, linear servos motors are provided to drive the print heads, at least transversely, over the substrate. Linear motors are easier to tune, require little service, and have better acceleration and deceleration than belt or other drive systems. Such servos provide accuracy that enables printing to be carried out while the heads are accelerating or decelerating. Programmed compensation is made for the variable head speed by the timing of the jetting of the ink. Thus, areas of the substrate having no printing can be skipped at high speed, greatly improving the speed and efficiency of the print operation by minimizing the time during which the print head is not depositing ink on the substrate.

Preferably, the patterns are applied to webs of material on which different products are to be quilted along the length of the material prior to the panels being separated from the web. Multi-needle quilting machines are also preferably used. Where the printing is applied to the web off-line, side-to-side registration that overcomes the effects of skewing or mis-orientation of the web achieves equally good registration of the different pattern copies being stitched simultaneously by the multiple needles and overcomes cumulative registration errors as the web is fed.

In certain other embodiments, vision systems may be employed to determine or verify the location of the printed pattern and to enhance or provide registration of the quilting with the printing. Such a vision system may be employed in addition or in the alternative to the computer control of the material transport.

Printed patterns or designs and the quilted patterns may be programmed or stored in memory and, in a programmed or operator selected manner, printed designs and quilted patterns may be combined in different combinations to produce a wide variety of composite printed and quilted patterns.

In alternative embodiments, the material may be held stationary, rather than moved relative to a fixed frame, and the printing and quilting heads of the respective printing and quilting stations may move relative to the frame and the material fixed on the frame, under the coordination of a controller, to bring a printing head or a quilting head into position over the portion of the material on which a pattern is to be applied. In most applications, quilting a pattern after applying a printed design is preferred. However, aspects of the invention can be utilized to print designs onto material after quilting the material.

Preferably also, a batch control automated system keeps track of the products moving through the process. Where one pattern applying process is off-line, such as where printing is carried out on a line separate from the quilting line on which the stitched pattern is applied, the control matches the quilted pattern and the printed patterns required by each product or batch of products. This can be carried out by maintaining information in a control system memory that will allow for the following of the product through the system or can be assisted by automatically identifying the product on the second line, such as by reading a code, such as a bar code, applied to the product previously and correlated with the pattern that was printed onto the panel or product. Batch control systems are described in U.S. Pat. No. 5,544,599 and in U.S. patent applications Ser. No. 09/301,653, filed Apr. 28, 1999, and Ser. No. 09/359,539, filed Jul. 22, 1999.

In the manufacture of mattress covers, printed and quilted top and bottom panels can be produced along with strips of border fabric that are to cover the border, including the sides and the head and foot, of a mattress. Such border panels can be produced with coordinated printed designs and patterns that match or correspond to the top and bottom panels. This can be achieved according to one embodiment of the invention by printing and quilting a strip of fabric along a width of the same web material of which the top and bottom panels are being made. The border panel printing and quilting are carried out under the control of a programmed controller, preferably the same controller that coordinates the application of the printed designs and quilted patterns on the top and bottom panels. The border panels so made are then cut or slit from the web that carries the top and bottom panels.

As an alternative to forming border panels out of the same web as the top and bottom panels, a separate but smaller machine having separate quilting and printing stations may be provided adjacent and linked to the main machine on which the mattress top and bottom panels can be applied. The separate machine is supplied with material for forming the border panels that is narrower than, but matches, the material supplied to the main machine for forming the top and bottom panels. Both machines are controlled by the same controller or controllers that are in communication with each other to coordinate the making of the mattress cover units or batches of units with matching or coordinated top, bottom and border panels. Border panels are of different widths, corresponding to mattresses of different thicknesses, and are of a length equal to the periphery of the mattress rather than the length of the mattress. In addition, border panels have thinner fill layers, being in the range of from ¼ to ½ inches thick, where the top and bottom panels are usually from ½ inch to 3 or 4 inches thick. For these reasons, the embodiment using the separate border panel machine is preferred in that it provides for more efficient use of different lengths of material and provides less process complexity.

According to certain other principles of the present invention, webs of ticking or units of other fabric are printed with patterns under the control of a computer controlled printer. Such printers are typically digital printers and may be referred to as digital printers, and include inkjet printers, continuous and dot-on-demand printers, and other printers that print images by dispensing ink or other printing medium in response to pattern information, which can usually vary from copy to copy, rather than from a physical mat, plate or mechanical transfer surface such as those commonly used for printing multiple copies of the same image.

In the preferred application of such principles, an ink jet printer scans a web of ticking material transversely and prints on the web in response to signals from a programmed computer. In one preferred embodiment of the invention, each scan row need not necessarily print only on the same panel, but can print one or more lines of each of several panels that are arranged transversely across the web of material. Each panel can be printed with the same pattern, each with a different pattern or some with the same pattern and others with one or more different patterns. Top and bottom panels that match or correspond to each of the border panels can be printed on different parts of the same or a different web.

Patterns on different panels of the same product, such as on adjacent top and side panels of a mattress cover, can be printed so as to be coordinated such that the patterns or pattern parts align when the mattress cover is assembled. Integrated panels can also be produced, with the side and top panels, for example, of a mattress cover attached at their common seams, with the patterns on each panel varied in size, shape and orientation as is appropriate for the respective panel. In addition, material can be printed to produce visually coordinated products, such as sheets, pillow cases, drapes and other products, with the patterns on the different products printed to different scales as are appropriate for the respective products. Such different products can then be arranged and printed on the same material in the most material efficient arrangement, with the print head scanning different ones of the products across the web. On quilted products, the printed patterns can be automatically scaled to accommodate shrinkage due to quilting, which can be based on either measured or calculated information.

After printing, the webs of ticking are usually quilted to one or more layers of fill material and usually a layer of backing material. The quilting may be applied to quilt different patterns on different panels or different sections of web containing more than one panel, or an entire web or length of web may be quilted with a generic pattern.

According to one aspect of the invention, Jacquard material, in which ornate patterns are woven into an otherwise plain material, is simulated by printing patterns on the same plain material background. In one application, for example, greige goods of the same background as the Jacquard material, can be printed to match the Jacquard material, with the actual Jacquard material providing the top and bottom panels of a mattress cover and the simulated material providing the border panels. In this way, the less noticeable border panels need not be made up in each and every Jacquard material, but a single print line can be set up to make, on demand, matching border panels in small lots to correspond to each product order.

After the printing and after the quilting, where applicable, different panels are separated from adjacent panels of the web by longitudinal slitting or transverse cutting. The cut panels are subsequently matched with other corresponding panels to form a mattress cover, which is matched with a spring interior unit and one or more layers of padding for assembly into a bedding product.

Each panel is preferably identified with a particular bedding product and may be identified with a particular item of a particular customer order. The identification and/or information relating to the properties of the panel can be contained in a computer file that is synchronized to each panel on the fabric. Such information can also be printed or coded on the fabric, on or adjacent a panel, preferably in the same printing operation that applies the printed panels to the material, which coding can be in the form of either manually readable information, machine readable information or a combination of manually readable and machine readable information. Such information can be manually read for control of the quilting, the cutting and slitting and the machine of panels and assembly into bedding products. Preferably, the information is automatically read and signals are then generated in response to the information to control the quilting of the printed material, the cutting and slitting of the panels from the web, and the matching of corresponding panels for assembly into bedding products.

Product labels such as those identifying the manufacturer, a retailer or a bedding product type or model, as well as describing the product, can be printed on the fabric in the same operation as the printing of a panel with a pattern. Further, the government required tag, called a law-tag, can be printed onto the substrate and the content of the tag can be derived from information in the system controller as to the content of the product being produced.

The present invention provides great flexibility in producing products of a wide variety of appearances and greatly reduces the ticking inventories of a mattress manufacturer.

The present invention also provides the ability to change printed patterns in the course of a quilting run, and to change both printed and quilted patterns to produce quilted products in a wide variety of composite patterns. With the invention, the number of base cloth supplies required to provide pattern variety is greatly reduced, saving substantial costs to the quilted product manufacturer. With the invention, the appearance of the outer layer can be embellished to provide variety and detail, and outline quilting can be carried out in high quality and in close proximity to the printed design. Further, with the invention, these advantages are available with both single needle and multiple needle quilters.

These and other objects of the present invention will be more readily apparent from the following detailed description of the drawings.

DETAILED DESCRIPTION OF THE PREFERRED EMBODIMENT

Figure 1:
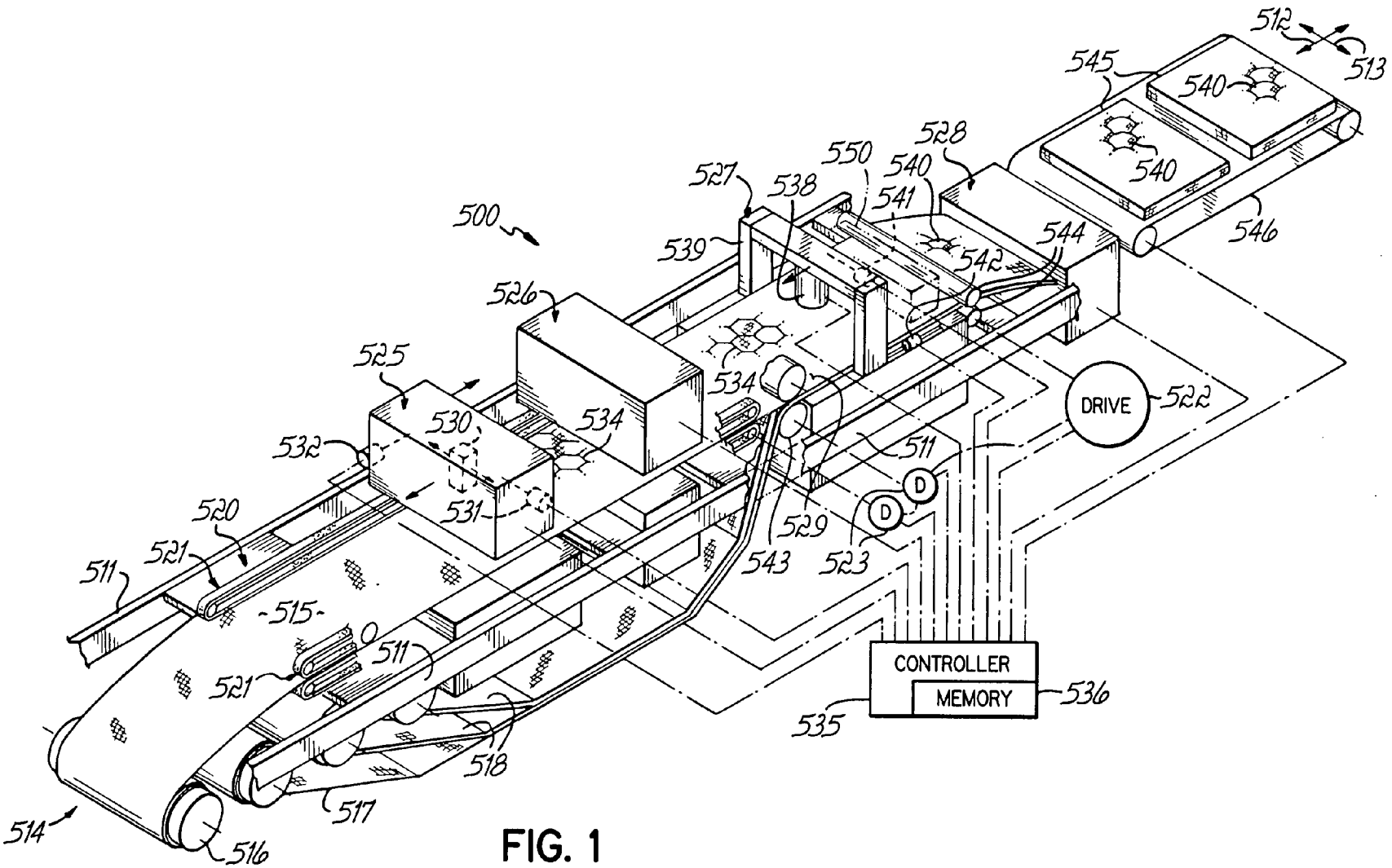
FIG. 1 is a diagrammatic perspective view of one embodiment of a web-fed mattress cover quilting machine embodying principles of the present invention.

FIG. 1 illustrates a combination printing and quilting machine 500 having a stationary frame 511 with a longitudinal extent represented by arrow 512 and a transverse extent represented by arrow 513. The machine 500 has a front end 514 into which is advanced a ticking or facing material 515. The facing material 515 is, in the illustrated embodiment of the machine 500, in the form of a web that is fed into the front end 514 of the machine 500 from a supply roll 516, which is rotatably mounted to the frame 511. A backing material 517 and one or more layers of filler material 518 are also supplied to the machine 500, preferably in web form from supply rolls that are also rotatably mounted to the frame 511. The layers of material are directed around a plurality of rollers (not shown) onto a conveyor or conveyor system 520, each at various points along the conveyor 520. The conveyor system 520 includes machine elements that engage and advance the materials through the machine 500, and control the position of the material so that other machine elements that operate on the material (print heads, quilting heads, cutters, etc.) can be located relative to the material or to features on the material, including edges or pattern components previously applied to the material by printing, sewing or otherwise.

In the embodiment shown in FIG. 1, the conveyor system 520 includes, for example, pairs of opposed pin tentering belt sets 521 which may alone or in cooperation with other elements extend the conveyor system 520 through the machine 500. In the machine 500, the outer layer 515 of facing material is fed to the belts 521 at the front end 514 of the machine 500. The belt sets 521 retain the web 515 in a precisely known longitudinal position thereon as the belt sets 521 carry the web 515 along the longitudinal extent of the machine 500, preferably with an accuracy of 0 to ¼ inch. The longitudinal movement of the conveyor system 520 is controlled by a conveyor drive 522. The conveyor 520 may include alternative forms of elements, including but not limited to opposed cog belt side securements, longitudinally moveable positive side clamps that engage and tension the material of the web 515, pin tentering elements or other securing structure for holding the facing material web 515 in a controlled or fixed position relative to the conveyor 520.

Along the conveyor system 520 are provided a plurality of stations, including a printing station 525, a drying station 526, a quilting station 527 and a panel cutting station 528. The backing material 517 and filler material 518 are brought into contact with the top layer 515 between the drying station 526 and the quilting station 527 to form a multi-layered material 529 for quilting at the quilting station 527. The layers 517 and 518 are, in the embodiment shown, not engaged by the belt sets 521 of the conveyor system 520 but rather are brought into contact with the bottom of the web of facing material 515 at the nip of a pair of rolls 543 upstream of the quilting station 527 and extended through the quilting station 527 and between a pair of pinch rollers 544 at the downstream end of the quilting station 527. The rollers 543 and 544 are elements of the conveyor system 520 and controlled to operate in synchronism with the belt sets 521 and pull the webs 517 and 518 through the machine 500 with the web 515. The rollers 543 and 544 may be mechanically linked to the conveyor drive 522 or may be driven independently through differential drives or motors 523. The drives 522 and 523 and the machine elements 521, 543 and 544 are preferably provided with sensing devices or encoders for providing control information feedback as to the location of the material in the machine.

The printing station 525 includes one or more printing heads 530 that are transversely moveable across the frame 511 and may also be longitudinally moveable on the frame 511 under the power of a transverse drive 531 and an optional longitudinal drive 532. Alternatively, the head 530 may extend across the width of the web 515 and be configured to print an entire transverse line of points simultaneously onto the web 515. The head 530 is provided with controls that allow for the selective operation of the head 530 to selectively print two dimensional designs 534 of one or more colors onto the top layer web 515. The drive 522 for the conveyor 520, the drives 531 and 532 for the print heads 530 and the operation of the head 530 are program controlled by a controller 535 to print patterns at locations on the web 515 that are preferably known in advance or will be remembered by the program of the controller 535. The controller 535 includes a memory 536 for storing such information and for storing pattern programs, machine control programs and real time data regarding the nature and longitudinal and transverse location of printed designs on the web 515 and the relative longitudinal position of the web 515 in the machine 500.

The drying station 526 is positioned relative to the conveyor system to dry the printed design 534 as the web 515 is conveyed longitudinally. In the embodiment shown, the drying station is fixed to the frame 511. The drying station may be of whatever configuration is suitable to effectively dry the ink or dye being applied at the printing station 525. It may operate continuously or be selectively controlled in accordance with the pattern, as is appropriate. The print head 530 is preferably a digital dot printer or ink jet printer with which the coordinates of each dot of the image printed are capable of being precisely located on the web 515 and relative to the conveyor 520. Alternatively, screen printed, roll printed or other types of printed images may be used while still realizing some of the advantages of the invention. Where a print head 530 such as an ink jet print head is used, the head may be moved transversely of the material by a carriage moveable on a transverse bridge with belts or chains driven by transverse drive servo 531, with the transversely extending bridge being moveable longitudinally on the frame 511 by a longitudinal drive servo 532.

Figure 1A:
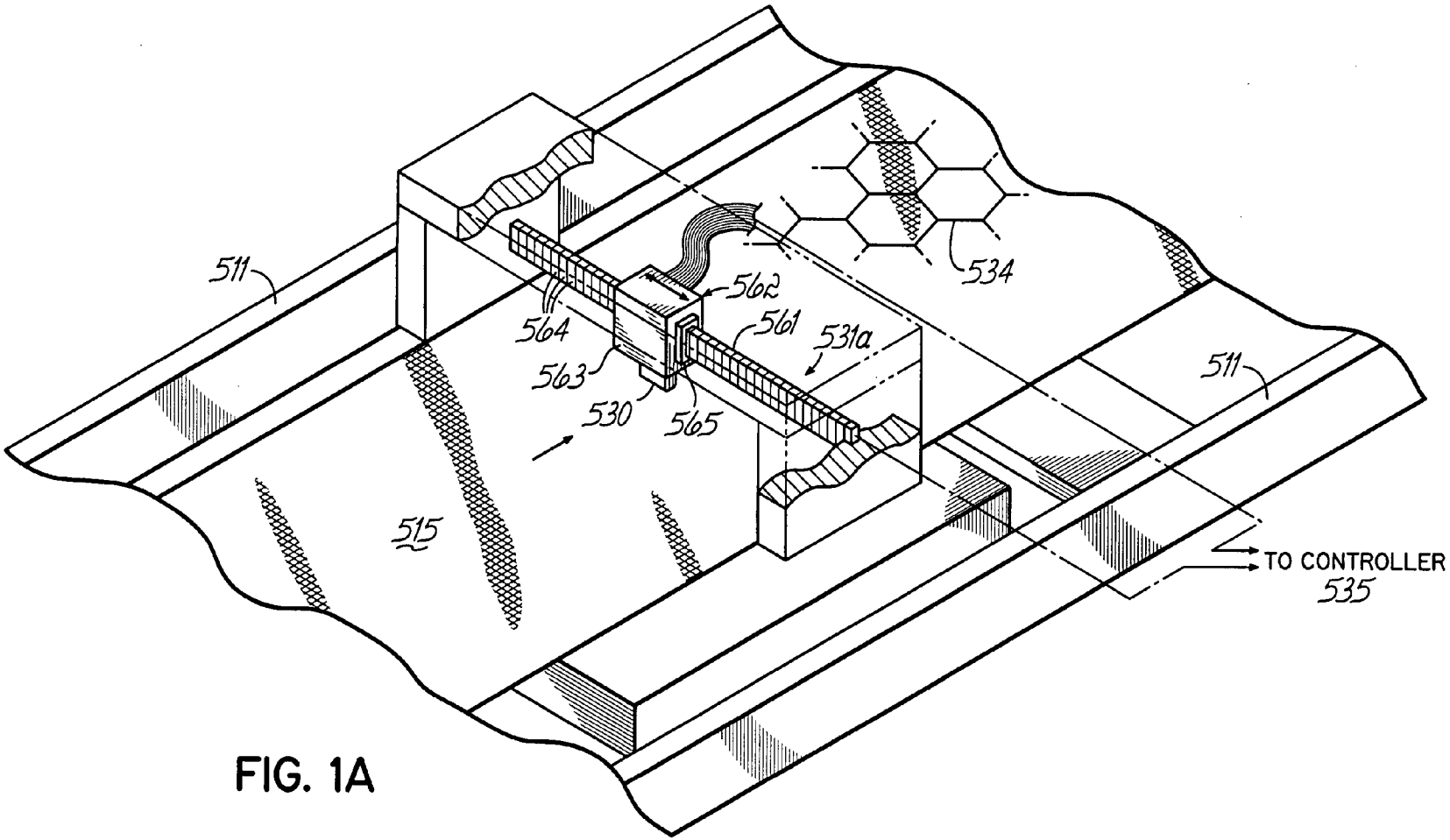
FIG. 1A is a diagrammatic perspective view of a portion of the machine of FIG. 1 illustrating one embodiment of the printing station thereof.

In preferred embodiments, the heads 530 include ink jet print heads having at least one multiple jet head for each of a plurality of, for example four, colors. The drives 531 and 532, and particularly the transverse drive 531, are preferably linear servo motors 531*a*, as illustrated in FIG. 1A. A transverse linear servo or servo motor 531*a* would include, for example, a stator 561 that is fixed to and extends across the bridge 560. On the stator 561 travels a transversely linearly moveable armature 562 to which is fixed a print head carriage 563 on which the print head 530 is mounted. The stator 561 includes a row of magnets, illustrated as an array of electromagnets 564 that are actuated by signals from the controller 535. Magnets 565 of the armature 562 exert forces on the armature 562 to move the carriage 563 and the print head 530 quickly and precisely among various transverse dot positions across the substrate 515.

Linear motors such as the servo 531*a* are easier to tune, require little service, and have better acceleration and deceleration than belt or other drive systems. Because of their accuracy, printing can be carried out while the heads are accelerating or decelerating, with programmed compensation in the timing of the jetting of the ink being made by the controller 535. This greatly improves the speed and efficiency of the print operation by allowing the print head 530 to skip across areas of the substrate 515 that are to have no printing to areas at which ink is to be deposited, minimizing the time during which the print head is not depositing ink on the substrate. Accordingly, linear servo motors, at least to transversely move the print heads across the bridge, are preferred for the machine 500 and for the print head drives of the other embodiments described below.

The quilting station 527 is, in this illustrated embodiment, a single needle quilting station such as is described in U.S. Pat. No. 5,832,849. Other suitable single needle type quilting machines with which the present invention maybe used are disclosed in U.S. Pat. Nos. 5,640,916 and 5,685,250. The quilting station 527 may alternatively include a multi-needle quilting structure such as that disclosed in U.S. Pat. No. 5,154,130. With such multi-needle machines, often the needles are fixed in the transverse and longitudinal directions of the material, reciprocating only perpendicular to the plane of the material, with the material being shifted transversely and/or longitudinally relative to the frame 511 under the control of the controller 535 to stitch patterns. In FIG. 1, a single needle quilting head 538 is illustrated which is transversely moveable on a carriage 539 which is longitudinally moveable on the frame 511 so that the head 538 can stitch 360° patterns on the multi-layered material 529. With 360° pattern forming on multi-needle machines, the drives 522, 523 would be capable of reversing the material in the longitudinal direction.

The controller 535 controls the position of head 538 relative to the multi-layered material 529, which is maintained at a precisely known position by the operation of the drive 522,523 and conveyor 520 by the controller 535 and through the storage and retrieval of positioning information in the memory 536 of the controller 535. In the quilting station 527, the quilting head 538 quilts a stitched pattern in registration with the printed pattern 534 to produce a combined or composite printed and quilted pattern 540 on the multi-layered web 529. The precise locations of the printed images on the material and the material relative to the frame of the machine are tracked in the memory 536, and this information is used by the controller 535 to relatively position the material and needles of the quilt head 538 to quilt in registration with the printing. This may be achieved, as in the illustrated embodiment, by holding the assembled web 529 stationary in the quilting station 527 while the head 538 moves both transversely, under the power of a transverse linear servo drive 541, and longitudinally on the frame 511, under the power of a longitudinal servo drive 542, to stitch the 360° pattern by driving the servos 541 and 542 in relation to the known position of the pattern 534 by the controller 535 based on information in its memory 536. Alternatively, the needles of a single or multi-needle quilting head may be moved relative to the web 529 by moving the quilting head 538 only transversely relative to the frame 511 while moving the web 529 longitudinally relative to the quilting station 527, under the power of conveyor drive 522, which can be made to reversibly operate the conveyor 520 under the control of the controller 535. Further, the quilting head, for example one containing a multi-needle array, may also be fixed transversely with the material being shifted transversely as well as moved longitudinally relative to the needles and the frame 511.

In certain applications, the order of the printing and quilting stations 525 and 527 can be reversed, with the printing station 525 located downstream of the quilting station 527, for example the station 550 as illustrated by phantom lines in FIG. 1. When at station 550, the printing is registered with the quilting previously applied at the quilting station 527. In such an arrangement, the function of the curing station 526 would also be relocated to a point downstream of both the quilting station 527 and downstream of the printing station 550 or be included in the printing station 550.

The cutoff station 528 is located downstream of the quilting and printing stations at the downstream end of the conveyor 520. The cutoff station 528 is also controlled by the controller 535 in synchronism with the quilting station 527 and the conveyor 520. The cut-off station 528 may be controlled in a manner that will compensate for shrinkage of the multi-layered material web 529 during quilting at the quilting station 527, or in such other manner as described and illustrated in U.S. Pat. No. 5,544,599 entitled Program Controlled Quilter and Panel Cutter System with Automatic Shrinkage Compensation. Information regarding the shrinkage of the fabric during quilting, which is due to the gathering of material that results when thick filled multi-layer material is quilted, can be taken into account by the controller 535 when quilting in registration with the printed pattern 534. For example, the dimensions of a quilted pattern or pattern component may be selectively reduced, and the spacings of pattern components may be similarly altered, in relation to the dimensions and spacings of components of the corresponding printed pattern, so that exact correspondence and registration between the quilted and printed patterns is attained.

The panel cutter 528 separates individual printed and quilted panels 545 from the web 538, each bearing a composite printed and quilted pattern 540. The cut panels 545 are removed from the output end of the machine by an out-feed conveyor 546, which also operates under the control of the controller 535.

Figure 2:
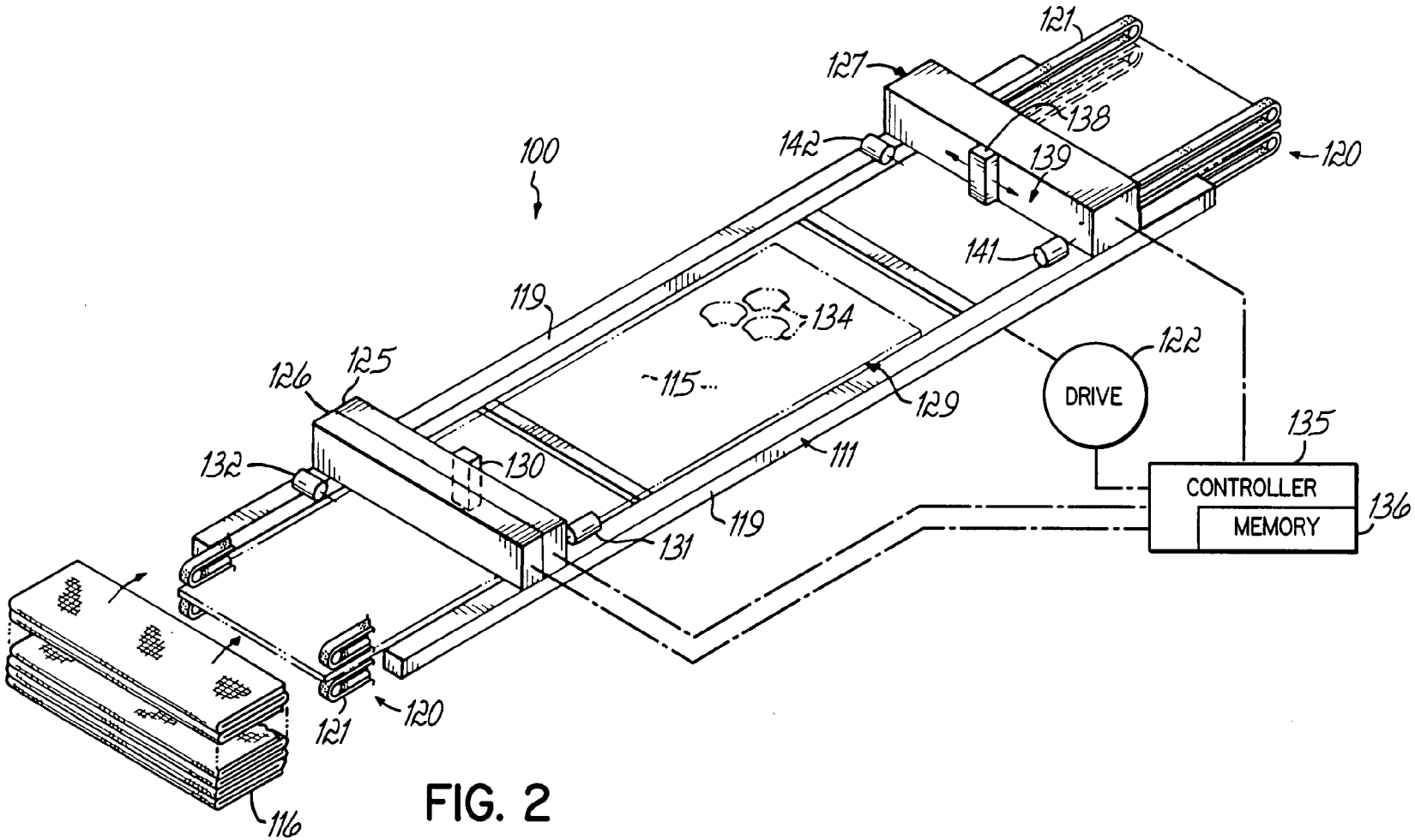
FIG. 2 is a diagrammatic perspective view of a discrete panel quilting machine which is an alternative embodiment to the machine of FIG. 1 that is more suitable for the production of comforters.

FIG. 2 illustrates an embodiment 100 of the invention that employs a single-needle, frame-supported, discrete-panel quilting machine such as those described in U.S. Pat. No. 5,832,849. Other machines of that type are disclosed in U.S. Pat. Nos. 5,640,916 and 5,685,250. These single needle quilting machines apply patterns to panels 129 that are often precut. Such machines are useful for manufacturing comforters, for example. The machine 100 has an operator accessible stack 116 of preformed panels from which the panel 129 is taken and loaded into the machine 100. A conveyor or conveyor system 120 moves a set of panel supporting edge clamps or other edge securements 121 to bring the panel 129 into a fixed position for application of a combination pattern by printing onto the outer top layer 115 of the multilayered fabric 129 and by quilting the multilayered fabric 129.

In the embodiment 100, a printing station 125, which in this embodiment includes a combined drying station 126 and a quilting station 127, is provided on moveable tracks 119 that are fixed relative to the machine frame 111. The printing station 125 includes one or more printing heads 130 that are transversely moveable across the frame 111 under the power of a transverse drive 132 and are longitudinally moveable under the power of a longitudinal drive 131. As with the embodiment 500 above, the drives 131 and 132 may be linear servo drives or other linear motors, such as those illustrated in FIG. 1A. The head 130 is controllable so as to allow for the selective operation of the head 130 to selectively print two dimensional designs 134 of one or more colors onto the top layer 115. The drive 122 for the conveyor 120, the drives 131 and 132 for the print head 130 and the operation of the head 130 are program controlled to print designs or patterns at known locations on the facing material 115 by a controller 135, which includes a memory 136 for storing programmed patterns, machine control programs and real time data regarding the nature and longitudinal and transverse location of printed designs on the material 115 and the relative position of the panel 129 in the machine 100. The drying station 126 may be moveable with the printing station 125, independently moveable on the frame 111, or fixed to the frame 111 in a position at which it can operate to cure the print medium applied by the printing head 130 without interfering with the printing station 125 or quilting station 127.

The quilting station 127, in this embodiment 100, is preferably a single needle quilting station such as is described in U.S. Pat. No. 5,832,849. The quilting station 127 has a single needle quilting head 138 which is transversely moveable on a carriage 139 which is longitudinally moveable on the frame 111 so that the head 138 can stitch 360° patterns on the multi-layered material 129. This is achieved, in the embodiment 100, by holding the panel 129 stationary while the quilting head 138 moves both transversely, under the power of a transverse servo drive 142, and the station 127 moves longitudinally on the frame 111, under the power of a longitudinal drive 141. The drives 141 and 142 may be linear servo drive motors. The servos can be operated to stitch a 360° pattern. Alternatively, the head may be stationary and the panel moved both transversely and longitudinally to stitch a 360° pattern, or one drive may be employed to move the head in one direction with the panel moveable in the other perpendicular direction.

The controller 135 coordinates the motion and operation of the printing station 125 and the quilting station 127 so that one applies a pattern or design to panel 129 and then the other applies a coordinated pattern or design in registration. The machine 100 can apply either the printed design first and then register the quilted pattern to it, which is the preferred order, or can apply the quilted pattern first and then register the printed design to the quilted pattern. The controller 135 controls the operation of these stations.

Figure 3:
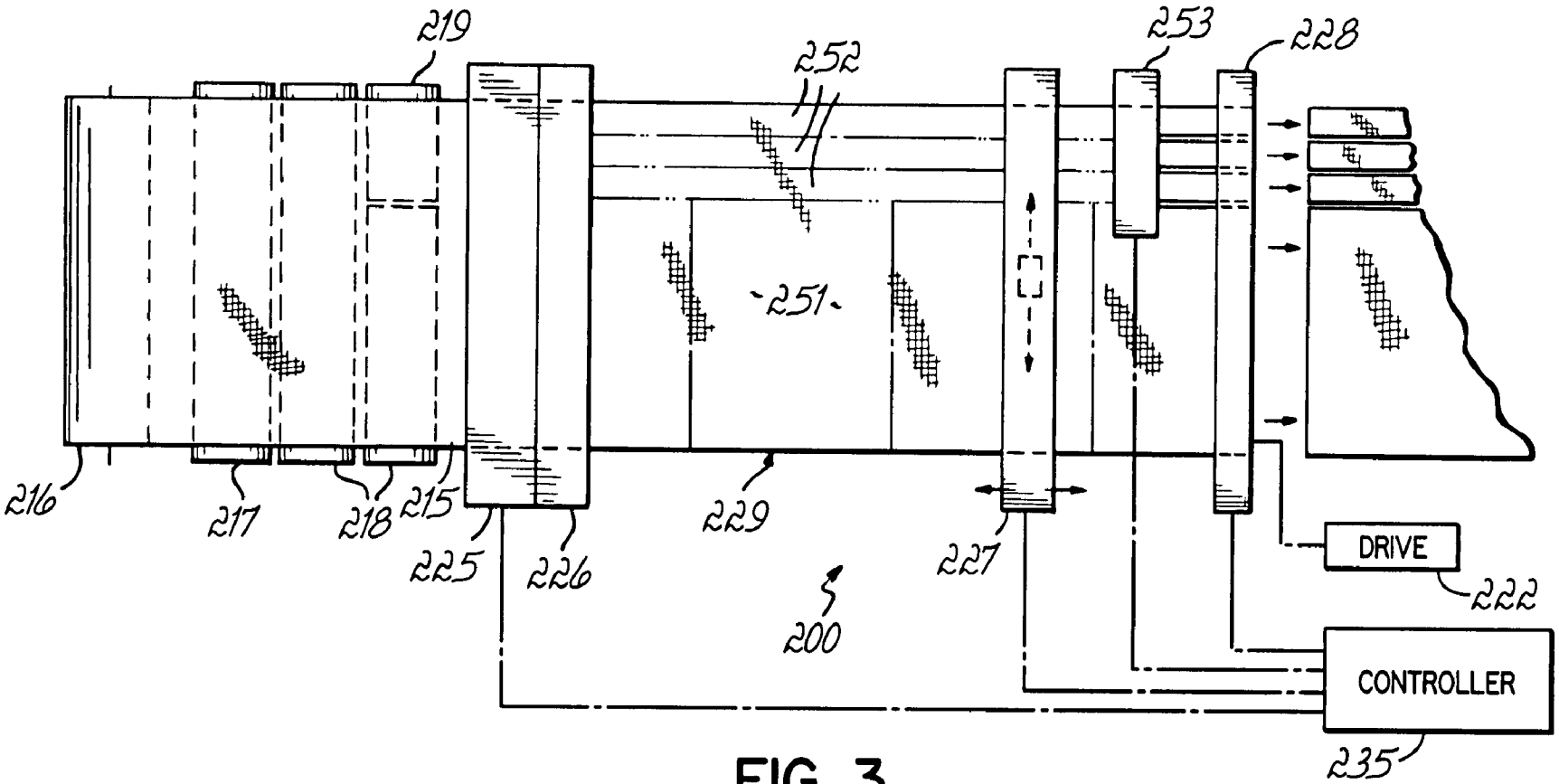
FIG. 3 is a top view of an alternative embodiment of the web-fed mattress cover quilting machine of FIG. 1 that includes structure for making coordinated top and bottom panels and border panels for mattress covers.

FIG. 3 illustrates an embodiment 200 that is similar in certain respects to the machine 500 of FIG. 1, but which further includes the capability to apply combination patterns to different areas of ticking material 215 on a wide multi-layered fabric 229 to produce top or bottom panels 251 with matching or otherwise corresponding border panels 252 of a mattress cover. In the preferred arrangement, a web of ticking or facing material 215 from a roll 216 is printed in an efficient arrangement of panels on the facing material 215. The machine 200 is provided with a supply 217 of backing material and supplies 218 and 219 of filler material, which are preferably, for this embodiment, of different thicknesses at different positions across the width of the facing material 215, to form the multi-layered fabric 229, on which the arrangement of panels is then quilted at a quilting station 227 in a way that spatially corresponds to the printed patterns. The machine 200 is also provided with a slitting station 253 adjacent cutoff station 228, to slit the border panels 252 from the top and bottom panels 251, and to otherwise cut the panels from the web of multi-layered fabric 229. The printing, quilting, cutting and slitting of the material as well as the movement of the material by operation of a drive 222 is controlled by a machine controller 235, which may be similar to those discussed previously.

Figure 3A:
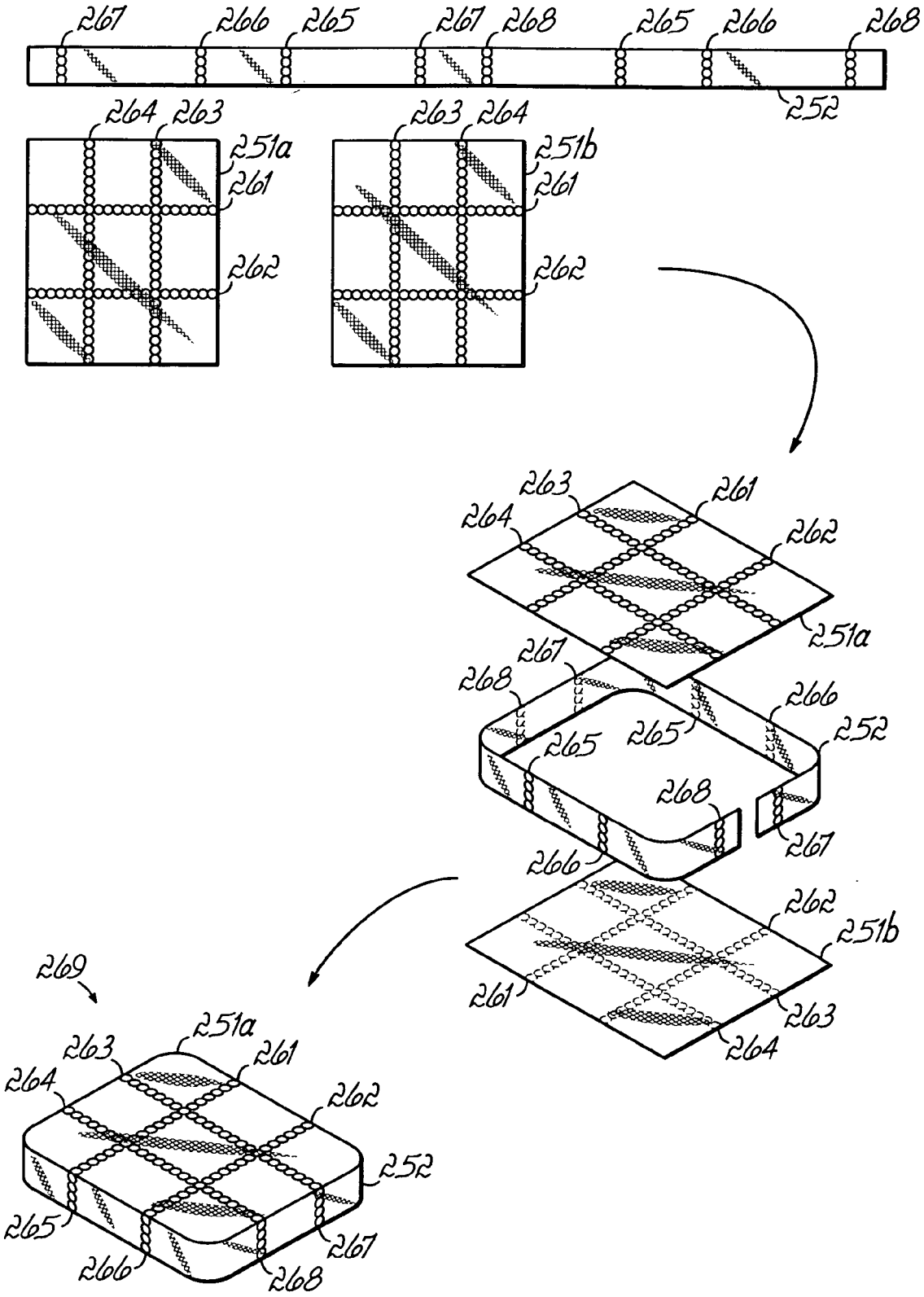
FIG. 3A is a diagram illustrating one manner of coordinating patterns between top, bottom and border panels of a mattress cover using various embodiments of the invention.

The patterns on the fabric 229 may be coordinated in such a way that, when the mattress covers are assembled, the patterns align. This is illustrated in FIG. 3A, in which severed top and bottom panels 251*a*, 251*b* and a continuous border panel 252 are illustrated, laid flat in the left side of the figure and folded for joining together as a mattress cover in the right side of the figure. The top and bottom panels 251*a*, 251*b* have pattern features 261–264 thereon while the side panel 252 has features 265–268 thereon. The features 261–268 may be printed, quilted or both. The features 265 are positioned on the side panel 252 so as to align with the features 261 on the top and bottom panels 251*a*, 251*b* when the panels are assembled into a mattress cover 269. Similarly, the features 266–268 are positioned on the side panel 252 to align with the features 262–264, respectively, on the top and bottom panels 251*a*, 251*b* when the panels are assembled into the mattress cover 269. Coordination of the panels 251 and 252 and assembly of the mattress covers 269 may be carried out as described in connection with the system 10 of FIG. 6, described below. The other embodiments described herein may be operated and controlled to produce mattress covers having the characteristics of mattress cover 269 of FIG. 3A.

Figure 3B:
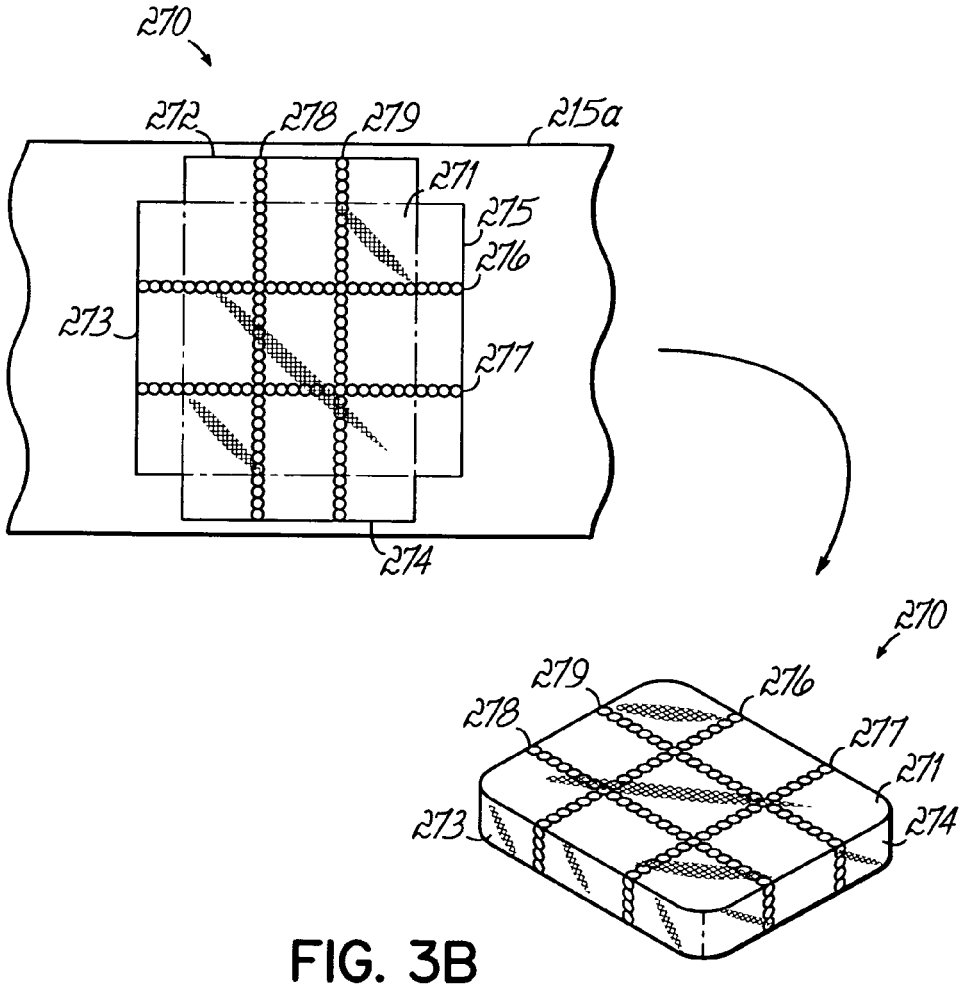
FIG. 3B is another diagram illustrating another manner of arranging patterns on side and bottom panels of a mattress cover and forming the panels out of a contiguous piece of material machine of FIG. 3.

FIG. 3B illustrates a mattress cover 270 having integral top and side panels 271–275 with pattern features 276–279 similar to features 261–268 of FIG. 3A printed and/or quilted onto ticking material 215*a*. Mattress cover 270 is particularly suitable for single sided mattresses, which are finished and padded on the tops but not on the bottoms, and which are not intended to be turned. Such mattress covers 270 are trimmed from a multi-layered printed and/or quilted web or panel, folded and sewn over a spring interior assembly to form the mattress cover 270.

Figure 4:
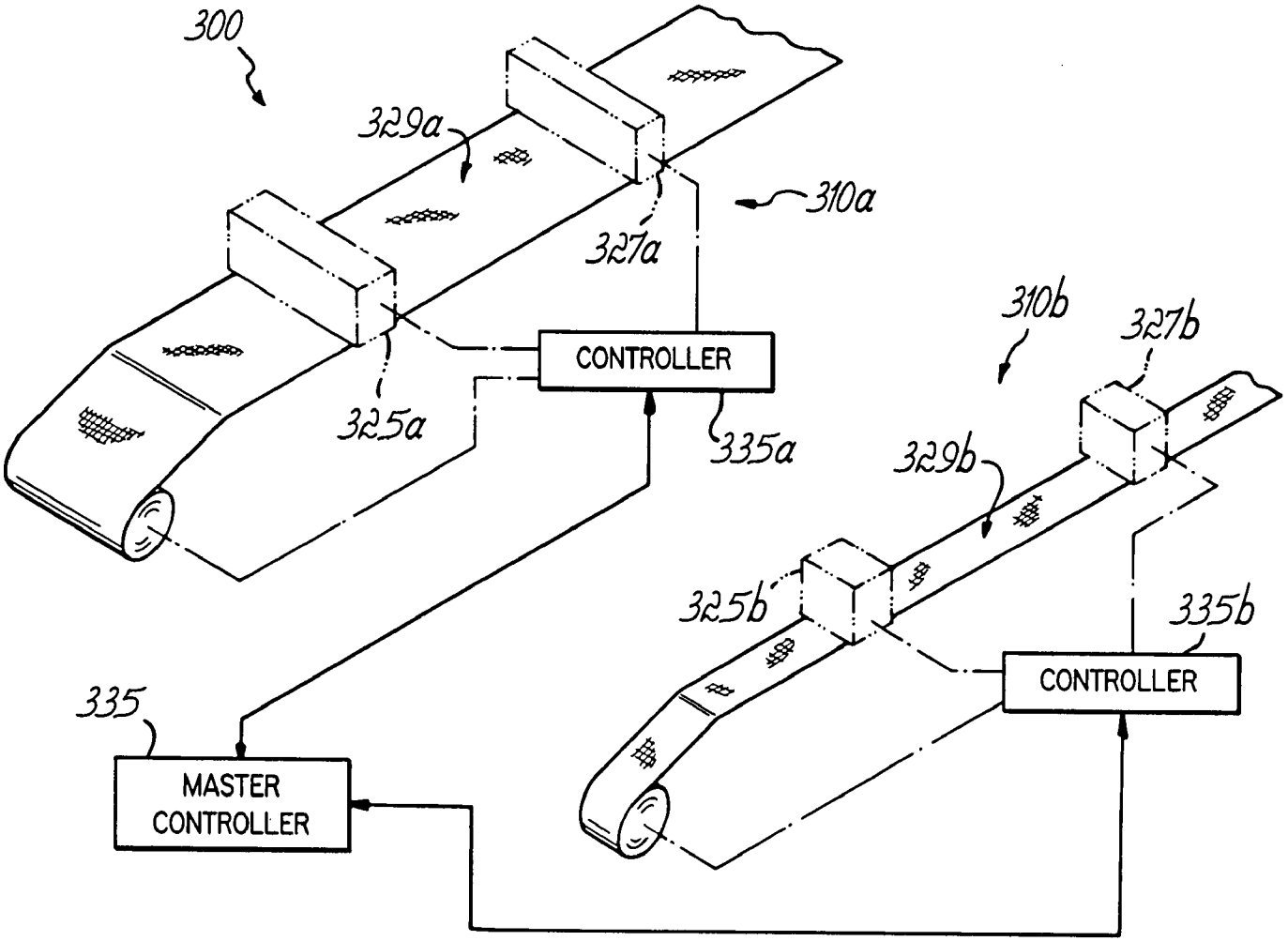
FIG. 4 is a diagrammatic perspective view of an alternative embodiment to the machine of FIG. 3.

FIG. 4 illustrates an alternative embodiment 300 for producing matching top and bottom panels and border panels for mattress covers. The embodiment 300 includes a machine 310*a* of the type similar to the machine 500 described in connection with FIG. 1 above in combination with a machine 310*b*, which is similar to but a narrower version of machine 310*a*. The machine 310*a* produces the top and bottom panels from multilayered fabric 329*a* that is dimensioned according to the specification for such panels, including a relatively thick filler layer 118*a* of mattress size width and length. The machine 310*b* produces the matching or coordinated border panels from multilayered fabric 329*b* that is dimensioned according to the specification for border panels, including a relatively thin filler layer 118*b* and narrower width that corresponds to the thickness of a mattress but greater length that corresponds to the perimeter of the border of the mattress. The matching of the combination patterns applied to the fabric 329*a*,329*b* is controlled either by a single controller, by a master controller 335 (as illustrated) which controls separate similar machine controllers 335*a*,335*b* of respective machines 310*a*,310*b*, or through other controller architecture. The separate controllers of the machines 310*a*,310*b* may be linked together such that they work in unison or such that the controller of one machine 310*a*,310*b* controls the other. Alternatively, the machines 310*a* and 310*b* may be controlled separately, in response to batch data, for example, which may be generated by a coordinated plant scheduling system. Where separately controlled, the output of the machines 310*a* and 310*b* may be tracked through computers that follow each mattress cover component of each product and order through the plant, relying on coordinated data files or indicia printed on the panels or both, as, for example, described in connection with the system 10 of FIG. 6, described below.

In FIG. 4, the controller 335*a* controls the operation of the machine 310*a* to produce combination printed designs and quilted patterns on the top and bottom panels of a mattress with printing head 325*a* and quilting head 327*a*, respectively, as with the machine 500 described above. Controller 335*b* controls the operation of the machine 310*b* to produce matching combination printed designs and quilted patterns on border panels for the same mattress with printing head 325*b* and quilting head 327*b*, respectively. Master controller 335 coordinates the operation of the two controllers 335*a*and 335*b*. Similarly, each of the machines 310*a* and 310*b* can be separated onto two production lines, one a print line containing a respective one of the printers 325*a*,325*b* and one a quilt line containing a respective one of the quilters 327*a*, 327*b*. As with the machines 310*a*,310*b*, the print lines and the quilt lines of each of the machines may be separately controlled or controlled together. The coordinating of the operations of the different machines and production lines and the coordination, batching and scheduling of the product components, may utilize features of system 10 of FIG. 6, described below.

The system 300 of FIG. 4 can be controlled to produce the coordinated panels 251,252 with the coordinated pattern features 261–268 illustrated in FIG. 3A. To produce the mattress cover 269, machine 310*b* would be controlled to produce the border panel 252 having the pattern features 265–268 while machine 310*a* would be controlled to produce the top and bottom panels 251*a*,251*b* having the pattern features 261–264.

Figure 4A:
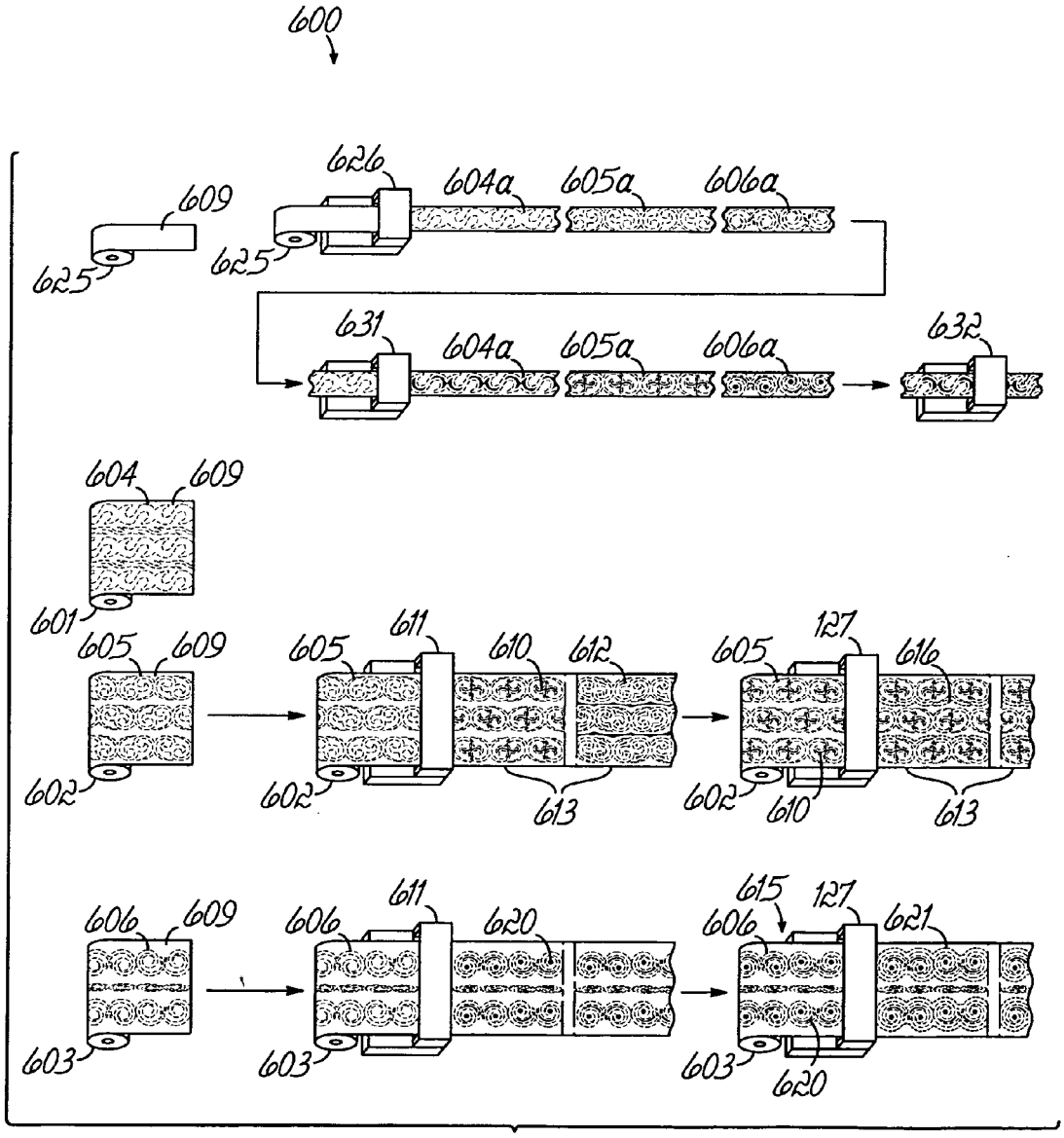
FIG. 4A is a diagram illustrating one embodiment of a method according to certain principles of the present invention.

An efficient use of the system 300 of FIG. 4 is illustrated in and described in connection with FIG. 4A. In FIG. 4A, a mattress cover production facility 600 is furnished with an inventory of different rolls of textile material 601–603, each being, for example, a Jacquard material in which different decorative Jacquard patterns 604–606 are respectively woven into the fabric 601–603. In the manufacture of mattress covers by the facility 600, a process is implemented, which may cause the printing of various printed patterns onto the Jacquard fabric 601–603. For example, patterns 610 may be printed onto material 602 with ink jet printing equipment 611 of the types described elsewhere herein. The patterns 610 may be located on the fabric 602 to coincide with or bear a spatial relationship to the Jacquard patterns 605 on the fabric 602. With the batch controls described elsewhere herein, printed patterns maybe changed from panel to panel along the fabric 602, with one panel 613 of the fabric 602 imprinted with a pattern 612 and a following panel 613 printed with the pattern 610. The web containing the printed panels 613 is then transferred to a quilting line 615 on which a quilted pattern 616 is applied to the printed panels 613. Similarly, patterns 620 may be printed onto material 603 with printer 611 in spatial relationship with the Jacquard patterns 606, and the web containing the printing then transferred or fed directly to quilting line 615 at which a quilted pattern 621 may be applied at a quilting station 627.

In the facility 600 of FIG. 4A, the different supplies of Jacquard material 601–603 have their respective woven patterns 604–606 applied to the same background material 609. The background material 609 may be completely untreated greige goods, or gray goods, or may be material that is partially treated so as to be in a ready-to-print condition. The inventory of the facility 600 is also made to contain a supply of border panel material 625 of a background material 609 having the same appearance as the background of Jacquard material 601–603. The border panel material 625 is subjected to a preliminary printing process in which simulated Jacquard patterns 604*a*–606*a*, resembling the woven Jacquard patterns 604–606, are printed onto the background or greige good material 625 to produce a border panel supply that has the appearance of any of the Jacquard materials 601–603. The border panel material printed to contain the different simulated Jacquard patterns 604*a*–606*a* is then transferred to a print line at which it is printed by a printer 631 similar to the printers 611 with any decorative pattern, including the patterns 610, 612 and 620. Alternatively, the simulated patterns 604*a*–606*a* and the decorative patterns 611,612,620 may be applied at the same print station in one or more print head passes to apply combined printed patterns under the control of a programmed controller. The printed border panels are then sent to a quilting station 632 similar to the quilt line 615 at which the border panels are quilted.

The process depicted in FIG. 4A has advantages of reducing inventory requirements and material handling in the mattress cover production facility 600. The method maybe integrated into the methods described elsewhere herein, particularly those in connection with FIG. 6 described below.

Figure 5A:
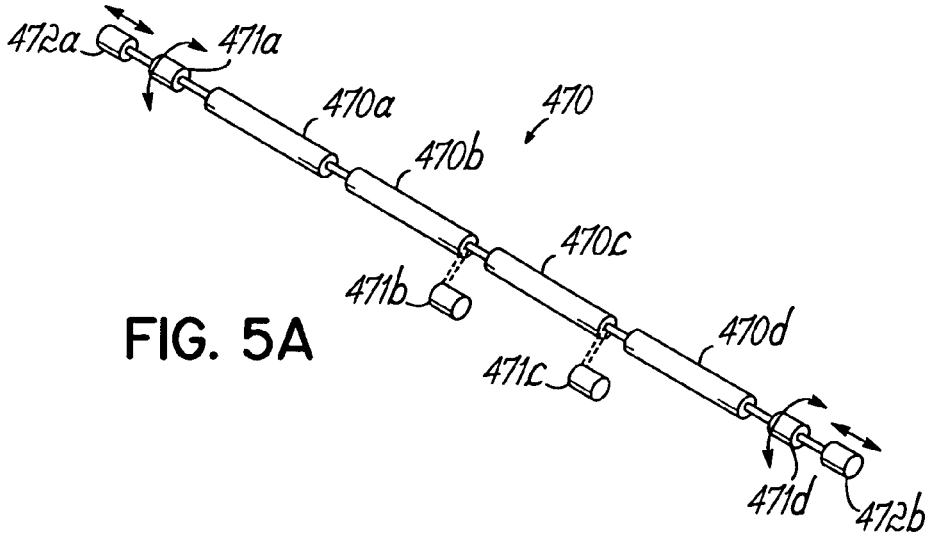
FIG. 5A is a perspective view of an alternative embodiment of the feed roll portion of the machine of FIG. 5.
Figure 5:
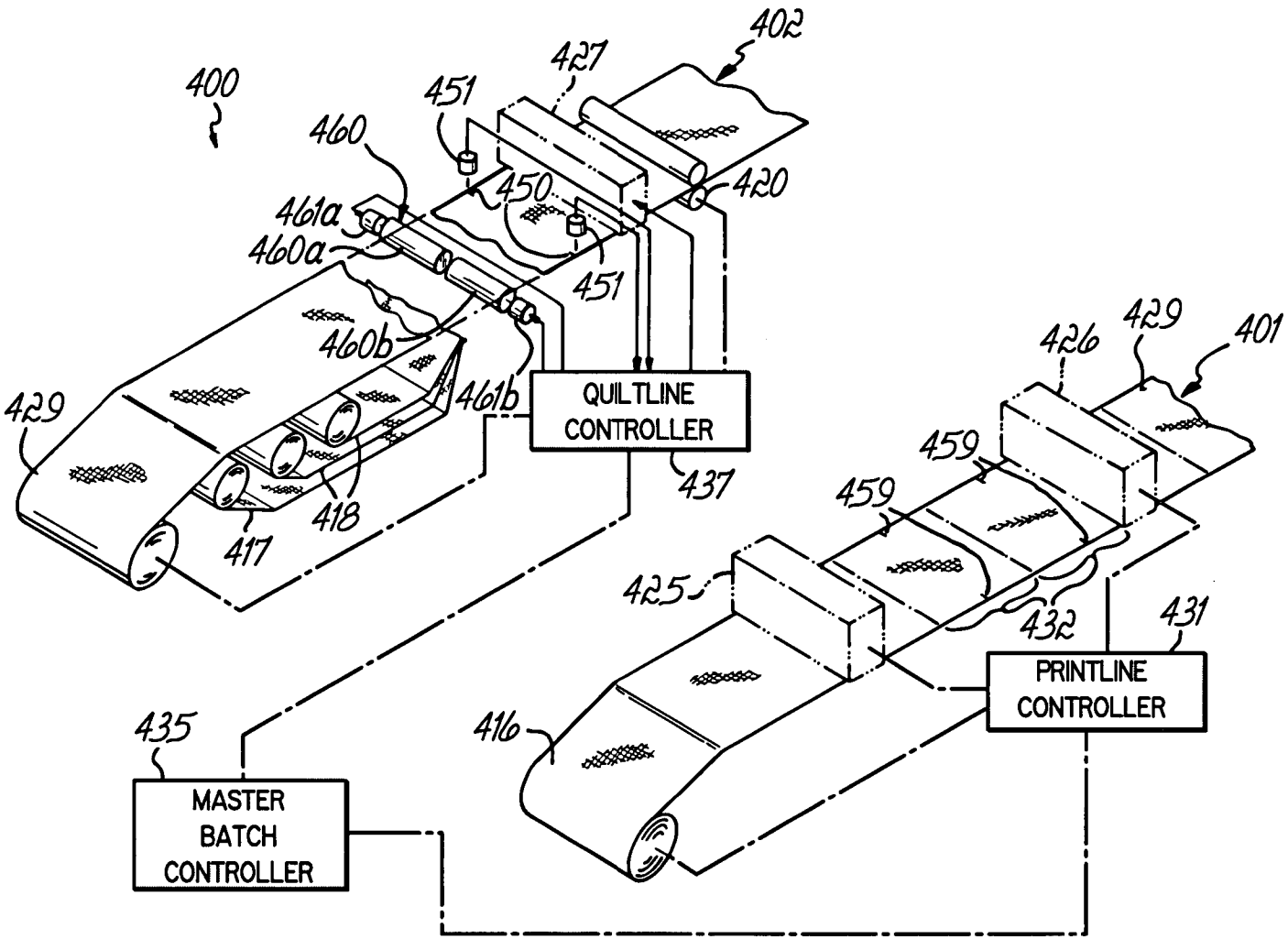
FIG. 5 is a diagrammatic perspective view of an off-line alternative embodiment to the machine of FIG. 1.

In the embodiment of FIG. 5, a printing and quilting system 400 is provided that includes separate print and quilting lines, such as print line 401 and quilt line 402. Quilt line 402 is preferably a multi-needle quilting machine such as that described in U.S. Pat. Nos. 5,154,130 or 5,544,599. The print line 401 includes a printing station 425, preferably of the jet printing type, and a curing or drying station 426, usually an oven but which may be a UV light curing station or such other station as will cure the type of ink being used. Mattress ticking material or some other facing sheet of material 416 is provided, preferably in web form, and fed successively through the printing station 425 and curing station 426. The printing station 425 applies patterns to the web of material 416 in accordance with pattern programs controlled by a print line controller 431. For the printing of top and bottom mattress cover panels, for example, patterns are printed on one or more successive panel lengths 432 along the web. The patterns may be changed from panel to panel in accordance with a schedule executed by a batch controller 435, which supplies product information to the print line controller 431. The print line 401 produces a plurality of printed panels preferably on a web 429 of the facing material from the supply 416.

In one preferred embodiment of the system 400, the printing performed on the print line 401 prints, in addition to a series of panel patterns, a series of registration or reference marks 450. The registration marks 450 are preferably printed on the opposite selvages or side edges of web 429 and are configured, for example in a Z-shape or such other shape that, when detected, can provide both longitudinal and transverse positioning references at each of the respective side edges of the web 429. The opposite marks 450 are preferably aligned with each other and include one opposed pair of marks for each panel, although more than one pair per panel may be used for added accuracy. The marks 450 are printed in a predetermined relationship to the location of the pattern being printed on the web 429, and data of this relationship is maintained in data files available to the controller 431 and to subsequent controllers, such as quilt line controller 437, for use in accurately positioning subsequent operations on the web 429, such as the application of a quilted pattern on the panels 459.

Further, associated with each panel there may be printed on the web 429 coded information that can be automatically read by a sensor and provided to a subsequent controller, such as controller 437 of quilting line 402, to identify a panel or bedding product component, to describe properties of the bedding product component, or to correlate with information in data files accessible to such controller that will provide process control or product information. Examples of the use of such data are set forth in the description of the system 10 illustrated in FIG. 6.

After printing, the web of preprinted material 429 is preferably re-rolled and transported, or otherwise directed, to the quilting machine or quilt line 402 into which it is loaded and on which it is combined with a backing liner web 417 and one or more filler material webs 418. The combined webs 429,417 and 418 are engaged by front feed rolls 460 from which they are advanced through a quilting station 427 of the multi-needle type at which a plurality of pattern components are quilted onto the previously printed web 429 in registration with the patterns printed thereon.

The quilting machine 402 has, immediately upstream of the quilting station 427, a pair of sensors 451, one over the right edge of the web 429 and one over the left edge of the web 429. The sensors 451 may be photo electric detectors that are capable of sensing the respective positions of the marks 450 so that a controller 437 of the quilting machine 402 can calculate the positions of the opposite edges of the web 429. The controller 437 is programmed to determine the longitudinal and transverse positions of the marks 450 and to derive therefrom the location of the printed patterns so that quilted patterns can be registered with the printed patterns. The program of the controller 437 also calculates any rotation of the panel or skewing of the web 429 relative to the coordinates of the machine 402. The controller 437 can then use the rotation information to adjust the angular orientation of a quilted pattern in applying it to the substrate in registration with the printed patterns and properly oriented on the panels 459. Such adjustment of the pattern is practical when the quilting station 427 is a single needle quilter. Alternatively, the angular orientation information is used to reorient the material 429. The reorientation of the material 429 is particularly more practical where the quilting station is a multi-needle quilting station.

According to the embodiment of FIG. 5, the quilting machine 402 is provided with a split feed roll 460 upstream of the quilting station 427. The split feed roll 460 includes a left half 460*a* and a right half 460*b*, each of which is separately controlled by an active or passive controllable element 461*a*, 461*b* such as a servo motor or brake. The controller 437 may, for example, differently drive servo motors 461*a*, 461*b* in response to skewing of the web 429 that is calculated as a result of the analysis by the controller 437 of the outputs of the sensors 451 so as to adjust the orientation of the web 429 as it advances through the line 402 and so as to affect the transverse position of the web 429, eliminating the skew. As a result, a quilted pattern can be applied in angular registration with the printed pattern. Multiple needles of the quilting station can maintain equal alignments with their respectively corresponding printed patterns. The skew correction, which may also be combined with a longitudinal and transverse adjustment of the web 429, results in high accuracy registration of the plurality of quilting needles with a plurality of components of, or location on, the printed patterns. The elements 461 can be used to control longitudinal tension on the web 429 entering the quilting station 427, and for this purpose, servo motors, or preferably brakes may be used to cause such tension to be applied, as explained further below.

In lieu of split feed rolls 460, other types of separately controllable feed elements that can feed or otherwise move the material in a way that will rotate or redirect the material to adjust the skew of the material can be used. For example, in system 500 of FIG. 1, the edge feed conveyor belts 521 can be configured in a series of flights, with a short flight downstream of the printing and drying stations 525 and 526 and upstream of the quilting station 527. The short flights of the conveyor belts 521 on each side of the web 529 can be separately controlled by the controller 535 based on information provided to the controller 535 of the actual orientation and position of the web 529 entering the quilting station 527. This orientation may be determined by registration marks such as the marks 450 of FIG. 5, from other sensing of the actual position and orientation of the web 529 or otherwise.

While FIG. 5 shows a split feed roll 460 having two halves 460*a*, 460*b* that can be differently controlled, the feed elements can be divided into more than two separately operable sections across the width of the web 429. For example, in FIG. 5A, a split feed roll 470 is illustrated that is divided into four sections, 470*a*–470*d*. The roll sections 470*a* and 470*d* affect the opposite edges of the web 429 and are driven by separately controlled drives 471*a* and 471*d*, respectively. Central sections of the roll 470, namely sections 470*b* and 470*c*, may be made to idle so that the web between the rolls 470*a* and 470*d* can freely adjust its position and orientation, or the rolls 470*b* and 470*c* can be geared in relation to the end sections of the roll 470*a* and 470*d* to conform to motion intermediate that of roll sections 470*a* and 470*d* in proportion to their distances from the respective end sections. Alternatively, the intermediate roll sections 470*b* and 470*c* can be separately or differentially driven by separate motors 471*b* and 471*c* that are independently controlled by the controller 437.

In addition, as FIG. 5A illustrates, the separate sections 470*a*–470*d* of roll 470 can be provided with relative transverse position adjustments, driven by controller controlled servos 472*a* and 472*b*, for example, to affect the transverse stretch or tension on the web 429. Such transverse adjustment can be coordinated with transverse tension applied to the web 429 by side securements (not shown) at the quilting station. Additionally, the feed roll 470 can be shifted transversely to generally center the web 429 entering the quilting station 427 to generally align the printed pattern on the fabric with the quilting head.

An alternative configuration of the embodiment 400 of FIG. 5 employs magnetic particle brakes for the controllable elements 461 in place of servo motors. With such brakes, differential tension is applied on the opposite side edges of the web 429 as the web is pulled by drive rolls 420 upstream of the quilting station 427. The unequal tension on the opposite side edges of the web 429 affects the skew adjustment. Further, by locating the split feed roll 460 upstream of a set of rolls (not shown) at which the backing and fill layer webs 417 and 418 are joined to the facing web 429, shrinkage of the facing layer 429 bearing the printed pattern can be controlled and limited, so that the printed pattern can be, in effect, lengthened relative to quilted pattern. Typically, the longitudinal scale of the printed pattern at the printing station 425 takes into account predicted shrinkage due to the gathering of material during quilting. Sometimes dimensional changes occur that result in a longitudinal shortening of the web 429 after it is printed and before it is fed to the quilting line 402. Controlling longitudinal tension of the web 429 can reduce the shrinkage from that predicted and can bring the longitudinal scale of the printed pattern and the quilted pattern into better correspondence. Alternatively, the quilted pattern could be electronically scaled at the quilting station 427 by the controller 437, but such scaling is not always aesthetically acceptable and, where the quilting station 427 employs a multi-bar multi-needle array is not always practical. Further, panel centric designs that must correspond to standard panel dimensions cannot be so freely scaled. Therefore, the ability to control the amount of shrinkage to either increase or decrease the panel width (which lies in the longitudinal direction on the web) is desirable. This ability eliminates the need to provide extra material between the longitudinally spaced panels to accommodate variations in shrinkage, which extra material would have to be removed by trimming, thus producing waste.

Figure 6:
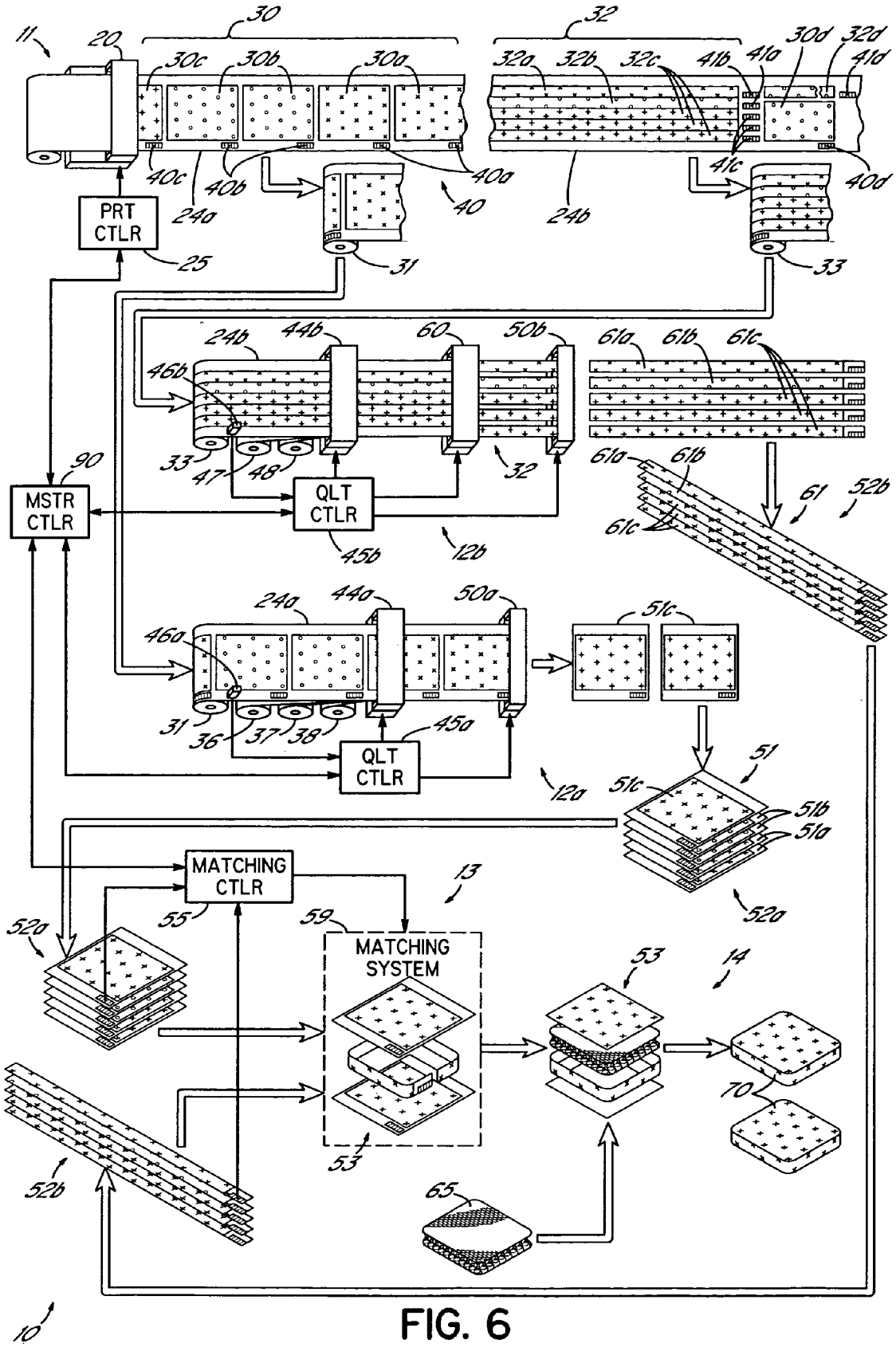
FIG. 6 is a diagram of one embodiment of a mattress cover quilting system embodying other principles of the present invention.

FIG. 6 illustrates a mattress cover manufacturing system 10 according to other aspects of the present invention. The system 10 can be divided into four subsystems or production lines, including at least one print line 11, at least one, and preferably two or more, quilting lines 12, illustrated as two quilting lines 12*a* and 12*b*, a mattress cover combining line 13 and a mattress assembly line 14. These production lines 11–14 may be located at a single bedding manufacturing facility or distributed among different facilities of the same or different companies.

Figure 6A:
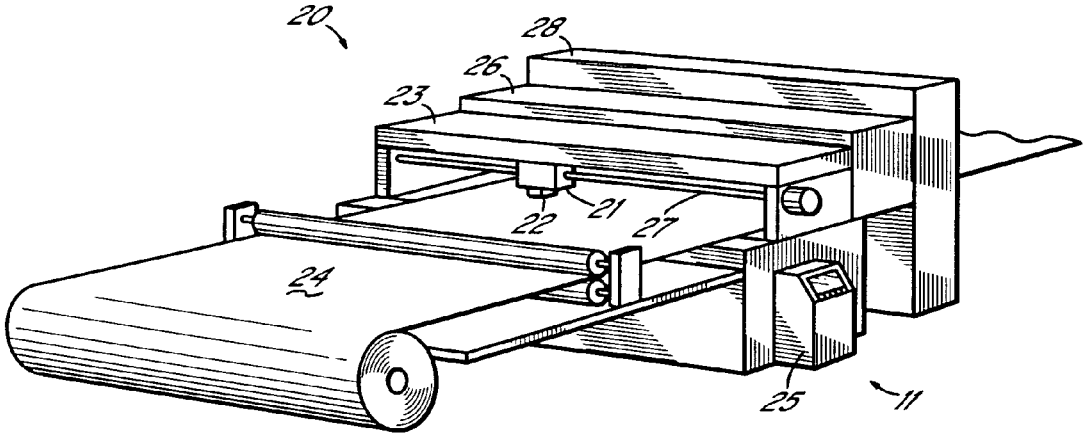
FIG. 6A is a perspective view of a pattern printing portion of the system of FIG. 6.

The printing line 11 includes an inkjet printing station 20 illustrated in more detail in FIG. 6A. The printing station 20 is operable to print an image from a memory, or otherwise in accordance with a programmed controller, onto mattress cover material. By so printing, the image can be controlled and varied from product to product along the material or from one portion of the material to another. Such printing may be referred to as digital or custom printing, although the control signals need not necessarily be, but preferably will be, digital signals, that determine the patterns and images to be printed.

At the printing station 20, a print head carriage 21 is preferably provided having one or more print heads 22 thereon. The carriage 21 is moveable transversely on a bridge 23, which is rigidly mounted to a frame 26 and spans the width of the printing line 11, which is wide enough to accommodate a print head path that traverses the width of the widest expected web 24 of mattress ticking, which may be nominally wider than the width of the king size mattress, which is 80 inches. The carriage 21 is preferably driven by a linear motor 27, which, along with the operation of the print heads 22, is controlled by a print line controller 25 to selectively print a dot pattern image on the web 24. The print heads, in the illustrated embodiment, scan individual lines across the entire transverse extent of the web 24 to print line-by-line along the length of the web 24, although the print heads 22 may be controlled to scan in different x-y paths to also print patterns in area-by-area or otherwise.

The printing station may include a UV curing station 26, at which UV curable ink is cured with ultraviolet light and/or a drying oven 28, which can further cure or dry UV inks or solvent based inks. A suitable printing station and method are described in the commonly assigned and copending U.S. patent application Ser. No. 09/390,571, filed Sep. 3, 1999, hereby expressly incorporated herein by reference.

The print line controller 25 includes a digital memory in which may be stored a plurality of pattern data files. Pattern and other data from these files, and/or from a master system controller or computer 90, can be printed at selected locations on the web 24. The master controller 90, in certain preferred embodiments, sends commands to the print line controller 25 to coordinate the printing of different mattress cover patterns onto the web 24 that are grouped together in batches that will be quilted in the most efficient sequence on the same quilting line 12, with a minimum of needle changes, material changes or other adjustments or operator interventions. Typically, this would mean that the top and bottom panels of a mattress cover would be grouped separate from the border panels, because the top and bottom panels are usually thicker, having more fill, than the border panels. Furthermore, top and bottom panels vary more in thickness from one mattress product to another while border panels often are of the same thicknesses for many different mattress products.

In FIG. 6, for example, patterns for a series of king size top and bottom panels 30 are shown printed along a length 24*a* of the web 24. These include: two panels 30*a*, a top panel and a bottom panel of a first printed pattern; two panels 30*b*, a top panel and a bottom panel of a second printed pattern to be printed; and a panel 30*c* of the next pattern to be printed. These patterns are shown as changing from one product to another for illustration purposes. More typically, several products of each pattern will be printed in succession according to an order schedule. These patterns 30 are printed under the batch control of the master controller 90 according to a schedule that assigns orders for products bearing the patterns of panels 30*a*–*c* to a particular print line 11, or to a particular series to be printed on the web section 24*a*. The grouping of the products to be made of the panels 30*a*–*c* to the same section of web 24*a* is assigned by the master controller 90 making the determination that these panels are to be quilted with similar quilted patterns and with the same fill components, so that they can be run on the same quilt line 12 without interruption to make machine adjustments or material or needle changes, for example. When all panels 30 that are to be quilted consecutively on the same quilting line 12 are printed on the web section 24*a*, the web section 24*a* is preferably cut and separately wound in a roll 31 for transfer to a quilting line 12*a* for quilting.

The controller 90 then batches border panels 32 for printing. These border panels 32 may be printed on the same or a different print line 11 on which the top and bottom panels 30 were printed. The border panels are long narrow strips typically 10 to 20 inches wide, but which may be wider or narrower, and usually in the range of from 18 to 27 feet long in order to surround the perimeter of a mattress, although they may be formed in shorter strips and later sewn together. The border panels 32 will be printed to match the top and bottom panels 30 that are printed onto the web section 24*a* and rolled in the roll 31. The border panels 32 may include, for example, a border panel 32*a*, which is printed of the same pattern as, or one matching, the pattern of the panel 30*a*. Similarly, border panels 32*b* may be printed with patterns corresponding to the pattern printed for the panels 30*b*, and border panels 32*c* may be printed with patterns corresponding to the pattern printed for panels 30*c*. The corresponding patterns can be printed in the same or a different orientation or size. These border panels 32 are printed on a web section 24*b* to be rolled into a roll 33 for transfer to the quilting line 12*b*, which is set up for the quilting of border panels.

Figure 7:
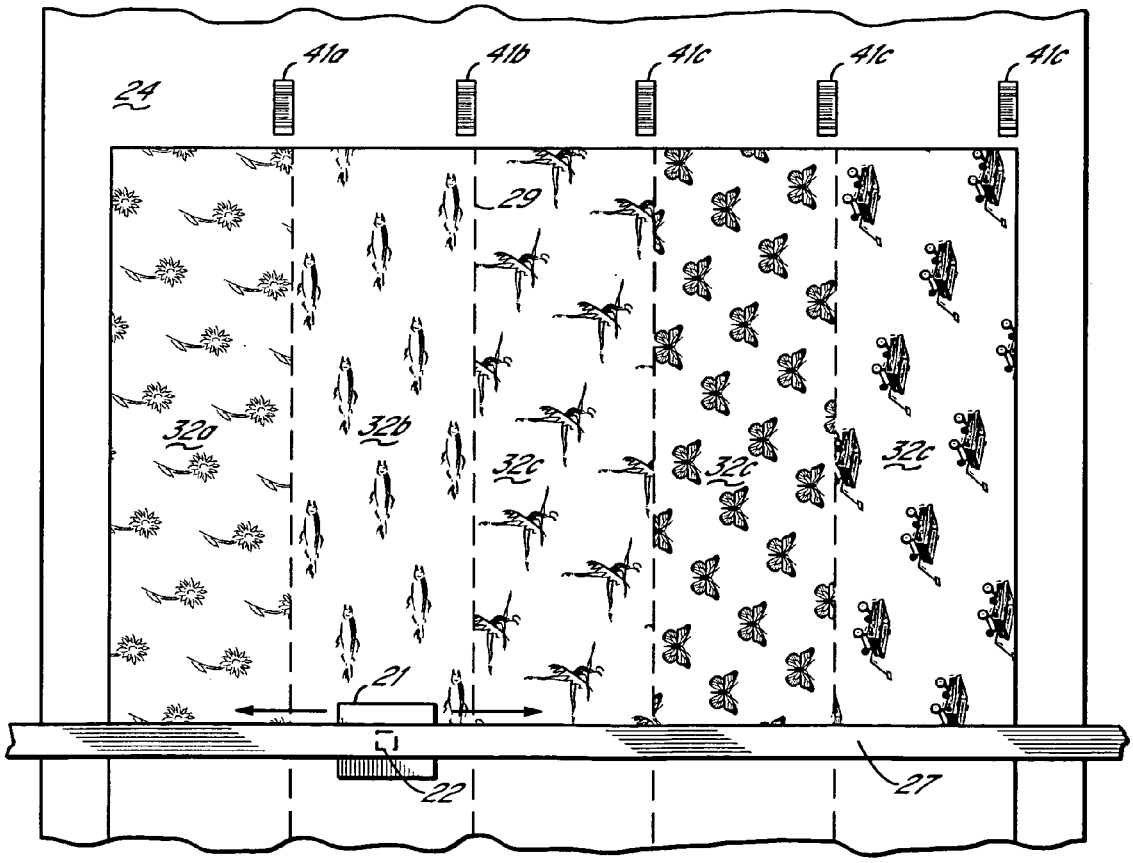
FIG. 7 is a fragmentary plan view of a web of ticking being printed at the print line of the system of FIG. 1 showing the transverse arrangement of a set of border panels bearing different patterns.

In the quilting of border panels 32, the long narrow panels 32 are arranged to most efficiently use the area of the web section 24*b*. For example, five 16 inch border panel strips can be printed across the width of an 80 inch web section 24*b*, as illustrated in FIG. 7. For this arrangement, the print head 22 is controlled by the print line controller 25 to scan the entire transverse width of the web, line-by-line, to print one row of dots of the different patterns of each of the five panels across the width of the web section 24*b*, then to print another row of dots, and so forth, until each consecutive row of dots is printed similarly as the web section 24 advances in one direction through the printing station 20. Alternatively, the print heads 22 can be moveable in a plane relative to the material and can be controlled to print selected areas of different patterns in various orders, as may be convenient. The patterns on the border panels across the width of the web 24*b* may be the same or each may be different, as illustrated. Cut lines 29 may also be printed to indicate where the panels 32 are to be slit or transversely cut from one another.

The arrangement of the patterns are printed on the web groups of the panels such that those having similar quilting parameters are grouped together. Panels having the same quilted patterns and that call for the same needle settings can be arranged contiguously on the material. Border panels, for example, of different products usually, but not necessarily, have the same fill characteristics. Panels of similar characteristics can be grouped together, and particularly if they have the same quilt patterns, can be arranged side-by-side. Where possible, the arrangements of the printed patterns on the material is carried out to minimize material waste and production inefficiency. Pattern arrangements can be made automatically by a batch mode controller or scheduling computer that is programmed to implement some arranging criteria.

In addition to border panels 32, top and bottom panels 30*d* can also be arranged on the web section 24*b*, which may be desirable where such top and bottom panels are to be quilted to the same thickness as that of the border panels 32. In such a case, a top or bottom panel 30*d*, for example, of a full rather than king size mattress, may be printed with the matching border panel 32*d* for the same mattress fit in along side of the top and bottom panels 30*d*.

Figure 7A:
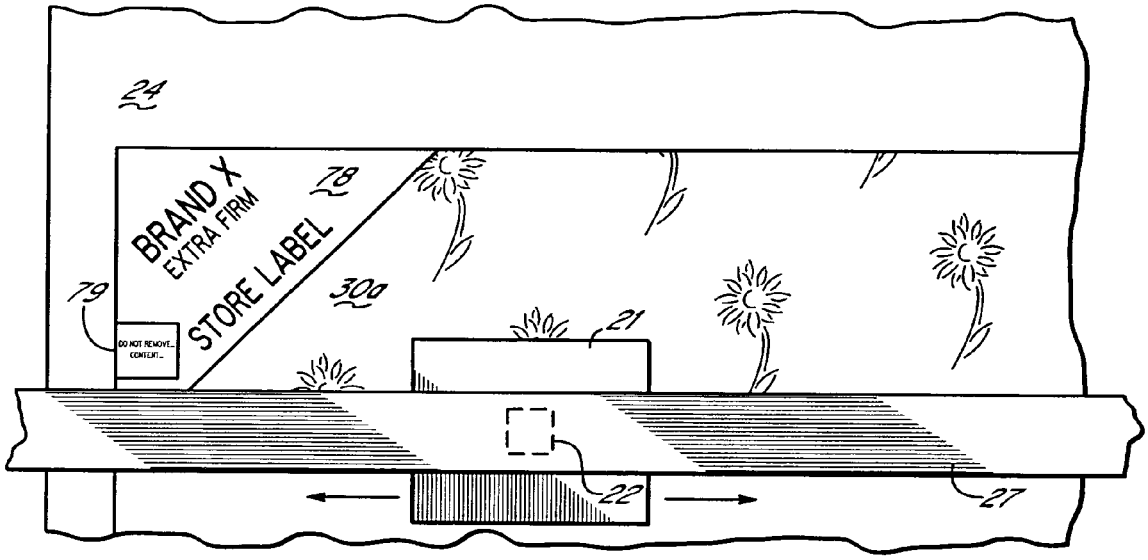
FIG. 7A is a fragmentary plan view of a web of ticking being printed at the print line of the system of FIG. 6 showing the printing of a bedding manufacturer's label along with the printing of a pattern on a top panel of a mattress cover.

Further, manufacturer or retailer labels, such as a retailer label 78, can be printed directly on the bedding products by the print heads 21 at the printing station 20, as illustrated in FIG. 7A. Heretofore, labels have been sewn onto bedding products. The retailer's label 78 can, instead, be printed along with the pattern on the print line 11 at, for example, the corner or edge of top panel 30*a*, as the carriage 21 scans the print head 22 across the web 24 to print the pattern for the panel 30*a* of a mattress identified to a specific order. Where a bedding manufacturer makes bedding for a number of retailers, labels can be customized to designate different store brands or product models. Even individual retail customer names can be applied for custom mattress orders. This can be done on a batch or piece-by-piece basis, as products for various retailers are batched for quilting. Such labels can be printed on a panel along with the pattern at the printing station 20. The labels can include machine readable information such as bar code encoded information identifying or describing the product, customer or order.

With the batch mode scheduling provided by the controller 90, provision is made for the communication of information to the quilting lines 12, the combining line 13 and the assembly line 14 so that the top and bottom panels 30 are correctly matched with border panels 32 and the resulting mattress cover is matched with the correct inner spring unit. This may be carried out by generating information records, which can be done in any of several ways. One method of coordinating information, and one of the more reliable, is by attaching information records to the mattress cover panels. This can be achieved by printing product codes at the printing station 20 along with the printing of the patterns on panels 30 and 32. Such printed records can be in the form of bar codes or other machine readable records.

Bar code labels are illustrated as areas 40 and 41 in the drawings. The codes 40 are, for example, shown in FIG. 6 as codes 40*a–d*, which contain information identifying the products for which top and bottom panels 30*a–d* belong, with bar codes 41*a–d* identifying the products to which border panels 32*a–d* belong. These codes are then read by sensors at subsequent stations so that subsequent operations can be automatically carried out that are appropriate for the particular products. In addition, or in the alternative, to the printing of machine readable indicia or codes, the printer can also print manually readable information that can be used by a quilting machine operator, by those manually matching components in a mattress cover or mattress assembly, or by others in subsequent operations.

In addition, a government required label or so-called "law tag", which discloses the content of a bedding product, can be calculated by the controller and printed at the time that the product is being manufactured. Such a tag can, for example, be printed at the time of the printing of the labels 41*c* or 78. Such a tag 79 can be permanently printed on the product, as illustrated in FIG. 7A. The text of such a tag 79 can vary with the content of the particular product, and can be calculated by information made available to the print line controller from the product or batch control information data files.

Rather than employ codes 40, 41 printed on the material to identify the patterns, electronic files containing identifying information can be synchronized among the controllers of the various lines through the master computer 90. For example, the printing of patterns at the print line 11 can cause information as to where and what was printed to be passed by the print line controller 25 to the master controller 90. The master controller 90 then transmits the printed pattern information along with information tracking the location of the printed patterns through the system 10 to the various controllers of the lines 12,13,14 controlling and keeping track of each product component in the flow through the system 10.

For the quilting part of the operation, the roll 31 bearing the top and bottom printed panels 30 on the web 24*a* of ticking is loaded onto the quilting line 12*a*, where the web 24*a* is combined with, for example, two layers of fill 36, 37 and one web of backing material 38. The layers are advanced through a quilting station 44*a* at which the layers are quilted together with, for example, a generic quilted pattern, such as a plurality of side-by-side continuous zig-zag patterns. Typical patterns, as well as a multi-needle quilting machine suitable for use as the quilting station 44*a*, are illustrated and described in U.S. Pat. No. 5,154,130, hereby expressly incorporated by reference herein. The quilting station 44*a* is controlled by a controller 45*a* which controls the quilting of the patterns under the control of the master controller 90 which selects the proper pattern for the product to which the patterns of the panels 30 relate. Coordination between the printed and quilted patterns may be accomplished, for example, by a sensor 46*a* which reads the printed codes 40, or by signals from the controller 90, communicated to the quilting station controller 45*a*.

The quilting line 12*a* also includes a panel cutting station 50*a*, which may also be operated by the quilting station controller 45*a* or a controller on the panel cutter in response to coordinating signals from a master controller, the quilting station controller or from codes read from the product such as by independently reading a bar code on the product. The cutter at the cutting station 50*a* uses coordination information from the controller 45*a*, which may include information read from the product, to determine where to sever the individual panels 30. Different panels may be cut to different lengths in accordance with product size information from batch control product parameter data through the controller 90. The cutting of the panels may be controlled to accommodate for "shrinkage" that occurs as the material dimensions change in the quilting process. The cutting produces completed individual rectangular top and bottom mattress cover panels 51, which include, for example, one pair of top and bottom panels 51 a bearing the printed patterns 30*a*, one pair of panels 51*b* bearing the printed patterns 30*b* and a series of panels 51*c* bearing the printed patterns 30*c*. Panel cutters are illustrated and described in U.S. Pat. No. 5,544,599 and in U.S. patent application Ser. No. 09/359,535, filed Jul. 22, 1999. These cut panels are then placed in a stack 52*a* and transferred to an area, referred to as a matching subsystem 59 of the combining line 13, at which the corresponding top and bottom panels are matched with corresponding border panels to make up the mattress cover sets 53 for each of the products. The matching may be coordinated manually or with the batch mode control by the system controller 90, directly, or through a separate matching controller or computer 55.

Similarly, the roll 33 bearing the printed border panels 32 on the web 24*b* of ticking is loaded onto the quilting line 12*b*, where the web 24*b* is combined with, for example, one layer of fill 47 and one web of backing material 48. The layers are advanced through a quilting station 44*b* at which the layers are quilted together with, for example, the same generic quilted pattern or patterns as applied at the quilting station 44*a* of the line 12*a*. The quilting station 44*b* is also controlled by a controller 45*b* which also controls the quilting of the patterns under the control of the master controller 90 which selects the proper pattern for the product to which the patterns of the panels 32 relate. Coordination between the printed and quilted patterns at the quilting line 12*b* may be accomplished, for example, by a sensor 46*b* which reads the printed codes 40, or by signals from the controller 90, communicated to the quilting station controller 45*b*.

The quilting line 12*b* also includes a panel cutting station 50*b*, which is also operated by the quilting station controller 45*b*, and is similar to the cutting station 50*a* of the quilting line 12*a*. The cutting station 50*b* can be controlled by the quilting line controller, through a master controller or independently by reading codes, such as bar codes, printed on the panels with the pattern. The cutter at the cutting station 50*b* uses coordination information from the controller 45*b* to determine where to transversely sever one set of transversely adjacent border panels 32 from another set. This transverse cutting may take place before or after the individual border panels are slit to separate one border panel from another. The cutting and slitting processes produce completed individual rectangular border panel strips. The border panels 61, which include, for example, one panel 61*a* bearing the printed patterns 30*a*, panel 61*b* bearing the printed patterns 30*b*, and panels 61*c* bearing the printed patterns 30*c*, are similarly cut from the material. These cut panels are then placed in a stack 52*b* and transferred to the matching subsystem 13 for matching with corresponding top and bottom panels as described above.

Provision for the slitting of transversely arranged panels is made by equipping one or all of the quilting lines 12 with a slitting station 60 for longitudinally separating panels 30, 32 or other panels one from another, or to trim the selvage or other material from the edges. Such a slitting station is illustrated in the quilting line 12*b*, where it is shown located between the quilting station 44*b* and the cutting station 50*b*. The slitting station 60 has a plurality of transversely adjustable and selectively operable slitting or trimming elements or knife assemblies (not shown), which can be positioned and operated to selectively slit the web 24*b*. In the embodiment shown, the knives can be operated to longitudinally slit the web 24*b* in four places to separate the five border panels 32 from each other. The completed border panels 61, so separated by slitting and transverse cutting, are then set in stack 52*b* for transfer to the matching station 13. The separate individual rectangular border panel strips 61 include, for example, border panel 61*a* bearing the printed patterns matching top and bottom panels 51*a*, border panel 61*b* bearing the printed patterns matching top and bottom panel 51*b*, and border panels 61*c* bearing the printed patterns matching top and bottom panels 51*c*. These cut panels are then placed in a stack 52*b* and transferred to the matching subsystem 13 for matching with corresponding top and bottom panels as described above.

Trimming knife assemblies may be made selectively operable and transversely moveable by motors or actuators under control of the quilting line controller 45*b*. Registration of the cutting and slitting station elements with the printed patterns is carried out at the quilting lines 12 or can be carried out on independent cutting lines on which the printed and quilted material is placed for cutting and trimming. Information for activating and/or positioning the trimming knives, as well as the transverse cutting knives, may be communicated via electronic files from the master controller 90 to the quilting and cutting line controllers 45*a*, 45*b*, or may be contained in coded information and/or separation lines 29 printed on the ticking with the patterns at the print line 11. The registration techniques and web alignment techniques of the parent applications identified above for registering the quilted and printed patterns may also be used for registering and aligning the cutting and slitting operations with the patterns printed on the web of ticking material. In locating the cuts and slits automatically, direct sensing of printed cut lines or calculated shrinkage compensation along with precise tracking of the material through the system should be employed.

After matching of the completed border panels 61 with the top and bottom panels 51 at the matching subsystem 59 of the combining line 13, the components of a mattress cover set 53 are assembled onto an inner spring unit 65 in a conventional manner on the mattress assembly line 14 to form the finished mattress products 70. The matching of the mattress cover sets 53 with the proper inner spring units 65 are also carried out under the control of the master controller 90. For proper matching, the inner spring units 65 as well as the mattress cover sets 53 may be provided with sensor readable coded labels or may be coordinated with electronic files by controller 90. The resulting products 70 may then include mattresses having covers and inner springs specified by product description parameters in data files processed by computer 90. Examples of such files are described in U.S. patent application Ser. No. 09/301,653, filed Apr. 28, 1999.

The coordination of printed patterns from component to component of a given product does not only combine components having identical patterns, but can combine products having scaled patterns varying primarily in size but otherwise matching, patterns varying in orientation, varying in color, or otherwise forming complementary components of an overall design. For example, border panel features may be scaled reductions of features printed in larger scale on the top and bottom panels. Further, different product components may be printed on the same material with the patterns oriented differently.

The above embodiments are described in the context of mattress cover or bedding product manufacturing, but certain features of the invention have additional applications. For example, while described in the context of a mattress manufacturing, the certain aspects of the method of arranging the printing of different patterns on mattress covers can be used for other applications where fabrics are printed, such as in the production of upholstery, bedspreads and comforters, and other textile and patterned fabric production.

The production of home furnishings, in general, can benefit from the coordinated manufacture of different articles having complementary printed patterns. Soft goods such as bedspreads, comforters, curtains and draperies, sheets and pillow cases, bed skirts or dust ruffles, table cloths and napkins and furniture slip covers can be efficiently made using various aspects of the equipment and methods set forth above. Doing so can avoid the need for a manufacturer to carry several different widths of fabrics, for example, by arranging and printing the different products from the same material sheet or web. A printing controller can, for example, carry a single data file of a given pattern or set of patterns with a scale factor stored in the product descriptions files for coordinated products. For example, a large print for bed coverings and small prints of the same patterns can be used for drapes, curtains, dust ruffles, pillow shams and other products. The various complementary products can be printed across the width of a wide material, and arranged and oriented on the material to make most efficient use of the cloth. By using data of one or more selected reference points on each product, the printing controller can scale and orient or otherwise modify each pattern so that the patterns appear correctly on each product as the print head scans across the textile or fabric. FIG. 7B illustrates such a printing scheme for the printing of large, medium and small floral patterns 681–683 on a bedspread 684, pillow cases 685 and a dust ruffle 686 on a common web of material 680.

Further, the principles involved in the coordination of printed patterns among the various panels of a mattress cover as described in connection with FIG. 3A above can be applied to the manufacture of apparel. For example, the sleeves and body panels of a shirt can be arranged efficiently on a single piece of fabric and the fabric can be printed with patterns differ from panel to panel or that are differently oriented from panel to panel, but that are placed on the different panels so that, when the panels are cut and sewn together the pattern parts form part of a coordinated design. This is illustrated, for example, in FIG. 3B.

While the above description is representative of certain preferred embodiments of the invention, those skilled in the art will appreciate that various changes and additions may be made to the embodiments described above without departing from the principles of the present invention.

We claim:

1. A method of manufacturing a quilted product comprising:

applying a record of information onto a textile material;

reading information from the applied record;

selecting one of a plurality of options in the manufacture of a quilted product in response to the reading of the information from the applied record;

manufacturing a quilted product by performing the selected option; and the manufacturing including quilting the material to form a mattress cover and matching the mattress cover, in response to the information, with one or more of a plurality of alternative bedding components to make a mattress.

2. A method of manufacturing a quilted product comprising:

applying a record of information onto a textile material;

reading information from the applied record;

selecting one of a plurality of options in the manufacture of a quilted product in response to the reading of the information from the applied record;

manufacturing a quilted product by performing the selected option; and the applying of the information including applying information identifying a particular customer from among a plurality of customers; and the manufacturing including performing manufacturing steps, in response to the information, selected from among a plurality of alternative manufacturing steps to form a quilted product specified by the particular customer.

3. A method of manufacturing a quilted product comprising:

applying a record of information onto a textile material;

reading information from the applied record;

selecting one of a plurality of options in the manufacture of a quilted product in response to the reading of the information from the applied record;

manufacturing a quilted product by performing the selected option; and the applying of the information including applying information identifying a particular order from among a plurality of orders; and the manufacturing including performing manufacturing steps, in response to the information, selected from among a plurality of alternative manufacturing steps to form a quilted product specified by the particular order.

4. A method of limiting inventory of ticking material in bedding manufacture comprising:

stocking ticking material having a woven pattern therein;

stocking generic ticking material;

printing the generic ticking material with a printed pattern simulating said woven pattern;

quilting mattress cover panels from ticking material having the woven pattern and the printed generic ticking material; and forming a mattress cover by joining the panel formed of the quilted printed generic ticking material to the quilted panel formed of the ticking material having the woven pattern.

5. A method of forming a patterned mattress cover comprising:

digitally applying printed ornamentation to one or more textile material substrates, said ornamentation including a printed pattern for at least one quilted textile panel that is to be quilted with a sewn pattern;

controlling the applying of the printed pattern and sewn pattern such that the printed pattern and the sewn pattern are scaled in relation to each other in one or more dimensions to compensate for the shrinkage during the quilting of the panel upon being quilted with the sewn pattern.

* * * * *